US007481526B2

(12) United States Patent
Inoue

(10) Patent No.: US 7,481,526 B2
(45) Date of Patent: Jan. 27, 2009

(54) IMAGE FORMING APPARATUS

(75) Inventor: Hiroshi Inoue, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 355 days.

(21) Appl. No.: 11/392,873

(22) Filed: Mar. 30, 2006

(65) Prior Publication Data

US 2006/0221166 A1 Oct. 5, 2006

(30) Foreign Application Priority Data

Mar. 31, 2005 (JP) ..... 2005-103130

(51) Int. Cl.
*B41J 2/01* (2006.01)

(52) U.S. Cl. ..... 347/101; 347/104

(58) Field of Classification Search ..... 347/104, 347/96, 102, 101, 4, 1, 103; 399/329, 296; 101/211

See application file for complete search history.

(56) References Cited

U.S. PATENT DOCUMENTS

| | | | | |
|---|---|---|---|---|
| 5,640,655 | A | 6/1997 | Shoji | |
| 5,893,018 | A * | 4/1999 | De Bock et al. | 399/302 |
| 6,052,551 | A * | 4/2000 | De Cock et al. | 399/296 |
| 6,084,620 | A * | 7/2000 | Morikawa et al. | 347/96 |
| 6,161,928 | A * | 12/2000 | Morikawa et al. | 347/96 |
| 6,201,945 | B1 * | 3/2001 | Schlueter et al. | 399/329 |
| 6,604,461 | B1 * | 8/2003 | De Bock et al. | 101/211 |
| 6,820,975 | B2 * | 11/2004 | Sugaya et al. | 347/104 |
| 6,902,267 | B2 * | 6/2005 | Ohya et al. | 347/104 |
| 6,926,399 | B2 * | 8/2005 | Yoshizawa et al. | 347/102 |
| 7,237,887 | B2 * | 7/2007 | Ueki et al. | 347/101 |
| 7,287,849 | B2 * | 10/2007 | Adachi | 347/104 |
| 7,370,948 | B2 * | 5/2008 | Inoue | 347/84 |
| 7,422,318 | B2 * | 9/2008 | Kadomatsu et al. | 347/102 |
| 2006/0061642 | A1 * | 3/2006 | Ueki | 347/101 |
| 2006/0164487 | A1 * | 7/2006 | Kadomatsu et al. | 347/102 |

FOREIGN PATENT DOCUMENTS

| | | | |
|---|---|---|---|
| JP | 9-15981 | A | 1/1997 |
| JP | 2001-179959 | A | 7/2001 |

* cited by examiner

*Primary Examiner*—Stephen D Meier
*Assistant Examiner*—Rene Garcia, Jr.
(74) *Attorney, Agent, or Firm*—Birch, Stewart, Kolasch & Birch, LLP

(57) ABSTRACT

The image forming apparatus comprises: an ejection head which ejects liquid onto a recording medium to form a desired image on the recording medium; a conveyance device which moves at least one of the recording medium and the ejection head so as to move the recording medium in a conveyance direction relatively to the ejection head; and a contact device which makes contact with the liquid on the recording medium and is arranged on a downstream side of the ejection head in the conveyance direction, the contact device having surface properties satisfying at least one of the following conditions: that a surface roughness of the contact device is greater than a surface roughness of the recording medium; that a surface free energy of the contact device is smaller than a surface free energy of the recording medium; and that a contact angle of the liquid on the contact device is smaller than a contact angle of the liquid on the recording medium.

9 Claims, 12 Drawing Sheets

FIG.8

| | SURFACE ROUGHNESS OF ABSORBING ROLLER (METAL PLATE 210) (μm) | | | | |
|---|---|---|---|---|---|
| SURFACE ROUGHNESS OF MEDIUM (METAL PLATE 200) (μm) | | 3.00 | 1.73 | 0.99 | 0.09 |
| | 3.00 | B | B | F | F |
| | 1.73 | A | B | B | F |
| | 0.99 | A | B | B | F |
| | 0.09 | A | A | A | B |

FIG.9

| SURFACE ROUGHNESS (μm) | SURFACE FREE ENERGY OF MEDIUM (METAL PLATE 200) ($mJ/m^2$) | SURFACE FREE ENERGY OF ABSORBING ROLLER (METAL PLATE 210) ($mJ/m^2$) | JUDGMENT |
|---|---|---|---|
| 3.0 | 16.4 | 37.6 | F |
| 3.0 | 37.6 | 16.4 | A |
| 1.7 | 13.9 | 38.4 | F |
| 1.7 | 38.4 | 13.9 | A |
| 1.0 | 9.0 | 39.5 | F |
| 1.0 | 39.5 | 9.0 | A |
| 0.09 | 14.4 | 40.9 | F |
| 0.09 | 40.9 | 14.4 | A |

FIG.10

| CONTACT ANGLE OF MEDIUM (METAL PLATE 200) (DEGREES) | CONTACT ANGLE OF ABSORBING ROLLER (METAL PLATE 210) (DEGREES) | JUDGMENT |
|---|---|---|
| 70~90(M) | 100~120(L) | F |
| 10~40(S) | 100~120(L) | F |
| 10~40(S) | 70~90(M) | B |
| 70~90(M) | 10~40(S) | A |

IMAGE FORMING APPARATUS

BACKGROUND OF THE INVENTION

1. Field of the Invention

The present invention relates to an image forming apparatus, and more particularly, to an image forming apparatus such as an inkjet recording apparatus, which forms images on a medium by using an image forming body, such as ink.

2. Description of the Related Art

In image forming apparatuses, such as inkjet recording apparatuses, an image is formed on a medium by using liquid ink in which coloring material and additives are mixed into a solvent, such as water, alcohol, or the like. Liquid (ink solvent) remains on the surface of the medium on which the image is formed, and this residual liquid on the surface of the medium can be the cause of image degradation (image defects), rear-side image transfer, cockling, and the like. In the inkjet recording apparatus, it is hence necessary to swiftly remove the liquid remaining on the medium, and various means of achieving this purpose have been devised. In particular, in systems which promote the fixing of the ink by causing the coloring material contained in the ink to become insoluble, or causing the coloring material to aggregate, by making a treatment liquid react with the ink the medium, the amount of liquid deposited on the medium is high, and there is a strong need for the liquid to be removed.

Moreover, if the ink coloring material is fixed principally on the surface of the medium, then depending on the three-dimensional shape (height) of the dots formed on the medium, relief effects may occur in the image formed on the medium. It is possible to eliminate relief effects occurring in the image by leveling (smoothing) the dots constituting the image.

Japanese Patent Application Publication No. 2001-179959 discloses an ink absorbing body and an image forming apparatus and method using the ink absorbing body, in which the ink absorbing body comprises a liquid solvent absorbing body and a separating member that covers at least partially the surface of the liquid solvent absorbing body and allows the ink solvent to pass, while having separating properties with respect to the coloring material of the ink. When ink is deposited on a sheet, the liquid solvent absorbing body is placed in closed proximity to a portion of the sheet through the separating member, and the liquid solvent is absorbed into the liquid solvent absorbing body through the separating member, in such a manner that the coloring material and the liquid solvent of the liquid ink on the sheet are mutually separated. Furthermore, there is also a composition in which a liquid volume sensor which determines the liquid volume inside a high polymer absorbing body is provided, and when the sensor value has reached a prescribed value, then a squeezing mechanism is operated.

Japanese Patent Application Publication No. 9-15981 discloses an excess developer liquid removal apparatus, in which a liquid absorbing body is used to remove excess developer liquid adhering to a drum, after wet development of an electrostatic latent image, and this liquid absorbing body is constituted by a surface layer made of an air permeable material having a surface free energy of 25 $mJ/m^2$ or below, on the outermost layer, and an elastic porous material formed on the layer below this surface layer.

However, when an absorbing medium used for liquid removal, or a pressing medium used for leveling the dots, is placed in contact with the print medium (the ink coloring material on the surface of the print medium) and pressed against same at a prescribed pressure, then some of the ink coloring material may be transferred from the surface of the print medium to the absorbing medium or the pressing medium, thus leading to a marked decline in image quality. Furthermore, if the ink coloring material becomes attached to the absorbing medium or the pressing medium, then it also becomes necessary to carry out maintenance for cleaning or replacing the absorbing medium or the pressing medium, thus giving rise to concerns relating to lower productivity, and reduced durability of the absorbing medium and the pressing medium.

In the ink absorbing body and image forming apparatus and method using same described in Japanese Patent Application Publication No. 2001-179959, although a concrete description is given in relation to the material having separating characteristics which is to be used in the ink absorbing body, no specific quantities are stated for the physical properties of the material, and therefore cases may arise where the ink is liable to adhere to the absorbing body, depending on the type of print medium used. In particular, the liquid is liable to remain between the coloring material and the absorbing body if the liquid is not removed sufficiently from the print medium, due to soiling or deterioration of the absorbing body, or the like, and situations such as this may affect the force of adhesion between the absorbing body and the ink.

Furthermore, in the excess developer liquid removal apparatus described in Japanese Patent Application Publication No. 9-15981, the surface free energy of the liquid absorbing body is specified, but other conditions, such as the surface roughness of the liquid absorbing body, are not specified, and hence there is a probability that the ink coloring material may adhere to the liquid absorbing body, depending on the type of medium used.

Moreover, in the above-described publications, there is no disclosure with regard to the relative magnitudes of the adhesive force acting between the ink coloring material and the medium, and the adhesive force acting between the ink coloring material and the liquid absorbing body. Therefore, depending on the type of medium used, and the surface roughness of the medium, the ink coloring material on the medium may adhere to the liquid absorbing body, and therefore, restriction of the possible range of choice of the media may be expected.

SUMMARY OF THE INVENTION

The present invention has been contrived in view of the foregoing circumstances, an object thereof being to provide an image forming apparatus which prevents deterioration of image quality, such as image defects, by suppressing the adherence of an image forming body, such as ink coloring material, to a medium which makes contact with the print medium or the image on the print medium, such as a liquid removal medium which remove liquid from the print medium, or a pressing medium which presses the ink on the print medium.

In order to attain the aforementioned object, the present invention is directed to an image forming apparatus, comprising: an ejection head which ejects liquid onto a recording medium to form a desired image on the recording medium; a conveyance device which moves at least one of the recording medium and the ejection head so as to move the recording medium in a conveyance direction relatively to the ejection head; and a contact device which makes contact with the liquid on the recording medium and is arranged on a downstream side of the ejection head in the conveyance direction, the contact device having surface properties satisfying at least one of the following conditions: that a surface roughness of the contact device is greater than a surface roughness of the recording medium; that a surface free energy of the contact device is smaller than a surface free energy of the recording medium; and that a contact angle of the liquid on the contact device is smaller than a contact angle of the liquid on the recording medium.

According to the present invention, the surface properties of the contact device which makes contact with the liquid on the recording medium are specified on the basis of the surface roughness, the surface free energy, and/or the contact angle of the liquid on the contact device, and by satisfying at least one of the following conditions: a greater surface roughness than the recording medium, a smaller surface free energy than the recording medium, and a smaller contact angle than the recording medium, then if the contact device makes contact with the liquid on the recording medium, the liquid does not adhere to or remain on the contact surface on the contact device, and there is no adherence of the liquid from the contact device, to the recording medium. Therefore, a desirable image is formed.

The contact device may be a pressing device, which presses the liquid (and the image forming body contained in the liquid), thereby smoothing (leveling) same, and a liquid removal device, which removes the liquid (solvent) on the recording medium. When the liquid (the image forming body) is leveled, then relief effects on the recorded image are suppressed. Furthermore, when the liquid on the recording medium is removed, then it is possible to prevent the occurrence of cockling on the recording medium.

Moreover, the liquid ejected from the ejection head may be ink containing an ink coloring material forming the image forming body, or a masking material such as resist, or the like.

The ejection head may be a line type head having a row of ejection holes of a length corresponding to the full width of the recording medium (the width of the possible image formation region of the recording medium), or a serial head which uses a short head having an ejection hole row of a length that does not reach the full width of the recording medium, and which scans this head in the breadthways direction of the recording medium.

A line ejection head may be formed to a length corresponding to the full width of the recording medium by combining short head having rows of ejection holes which do not reach a length corresponding to the full width of the recording medium, these short heads being joined together in a staggered matrix fashion.

Moreover, "recording medium" indicates a medium which receives ejection of an image forming body by means of an ejection head, and this term includes various types of media, irrespective of material and size, such as continuous paper, cut paper, sealed paper, resin sheets, such as OHP sheets, film, cloth, and other materials.

Preferably, the contact device includes a liquid removal device which removes the liquid by making contact with the liquid on the recording medium.

Removal of liquid by the liquid removal device may be based on a mode in which the liquid is absorbed and removed by means of an absorbing member, such as a porous member, polymer, or the like, in the portion which makes contact with the liquid, or a mode in which the liquid is suctioned and removed by means of a suction device (pump), through the small apertures provided in a resin or metal member having a large number of small apertures in the portion which makes contact with the liquid.

Preferably, the contact device has the surface properties satisfying at least one of the following conditions: that the surface roughness of the contact device is not less than twice the surface roughness of the recording medium; that the surface free energy of the contact device is not more than a half the surface free energy of the recording medium; and that the contact angle of the liquid on the contact device is not more than a half the contact angle of the liquid on the recording medium.

According to this aspect of the present invention, a suitable margin can be obtained in the surface property of the contact device. When sufficient margins are obtained in the surface properties of the contact device, then the applicable contact pressure range of the contact device becomes broader and the improved efficiency of processing can be expected.

Preferably, the image forming apparatus further comprises: another contact device having surface properties different from the former contact device, in respect of at least one of the surface roughness, the surface free energy and the contact angle of the liquid; and a switching device which select one of the contact devices to make contact with the liquid on the recording medium.

By adopting a composition in which a plurality of contact devices having different physical properties (surface properties) are selectively switchable, then it is possible to use the contact device having optimal surface properties.

Preferably, the image forming apparatus further comprises: a recording medium determination device which determines a type of the recording medium; and a switching control device which controls the switching device according to the type of the recording medium determined by the recording medium determination device.

Since a composition is adopted in which the contact devices can be switched selectively in accordance with the type of recording medium, then the desirable contact device is used in accordance with the type of recording medium.

The mode of determining the type of the recording medium by the recording medium determination device may involve the user inputting information about the recording medium, or alternatively, the recording medium may be read in directly by means of a determination device, such as a sensor or imaging element, the type of the recording medium being determined automatically on the basis of the results thus read in. Furthermore, it is also possible to adopt a composition in which an information recording body (memory, IC tag, or the like) which stores information including information on the recording medium is provided in the supply device which supplies the recording medium, in such a manner that the type of the recording medium (recording medium type) is read in from this information recording body.

In order to attain the aforementioned object, the present invention is also directed to an inkjet recording apparatus, comprising: an ejection head which ejects ink onto a recording medium to form a desired image on the recording medium; a conveyance device which moves at least one of the recording medium and the ejection head so as to move the recording medium in a conveyance direction relatively to the ejection head; and a contact device which makes contact with the ink on the recording medium and is arranged on a downstream side of the ejection head in the conveyance direction, the contact device having surface properties satisfying at least one of the following conditions: that a surface roughness of the contact device is greater than a surface roughness of the recording medium; that a surface free energy of the contact device is smaller than a surface free energy of the recording medium; and that a contact angle of the ink on the contact device is smaller than a contact angle of the ink on the recording medium.

If an image is formed by means of a pigment-based ink, then the ink solvent and the ink coloring material are separated, and the ink coloring material is fixed onto the recording medium, while the ink solvent is removed from the recording medium. A commonly used method for removing the ink solvent is one in which an absorbing member, such as a porous member, is placed in contact with the ink solvent, and by applying the present invention to this absorbing member, it is possible to prevent adherence of ink coloring material to the absorbing member, even when the absorbing member makes contact with the ink (and the ink coloring material). Furthermore, if the ink coloring material is leveled by pressing the ink coloring material on the recording medium, then by applying the present invention to the pressing device which presses the ink coloring material, it is possible to prevent the adherence of the ink coloring material to the pressing device. Consequently, the present invention has a particularly significant effect in cases which use a pigment-based ink in which the ink coloring material is fixed on the surface of the recording medium.

Preferably, the inkjet recording apparatus further comprises a treatment liquid ejection head which ejects treatment liquid which fixes the ink on the recording medium by reacting with the ink.

In a two-liquid type of inkjet recording apparatus which promotes the fixing of the ink by causing the treatment liquid to react with the ink, unreacted ink (ink solvent) and surplus treatment liquid are removed efficiently, and furthermore, desirable liquid removal is achieved, without removing the ink coloring material. Particularly beneficial effects can be obtained in a two-liquid type of inkjet recording apparatus, which ejects a large volume of liquid (solvent) onto the recording medium.

According to the present invention, a contact device which makes contact with the liquid forming an image on a recording medium satisfies one of the following conditions, namely, a surface roughness that is greater than that of the recording medium, a surface free energy that is smaller than the recording medium, and a contact angle that is smaller than the recording medium. Therefore, even when the contact device makes contact with the liquid, the liquid does not adhere to the contact device, and hence there is no occurrence of image defects or image deterioration in the image formed on the recording medium. The contact device may be a pressing device which presses against and levels the liquid, or a liquid removal device which absorbs and removes the liquid.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 8 is a diagram showing the relationship between the recording medium and the absorbing roller in the surface roughness;

FIG. 9 is a diagram showing the relationship between the recording medium and the absorbing roller in the surface free energy;

FIG. 10 is a diagram showing the relationship between the recording medium and the absorbing roller in the contact angle;

DETAILED DESCRIPTION OF THE PREFERRED EMBODIMENTS

First Embodiment

General Composition of Inkjet Recording Apparatus

Figure 1:
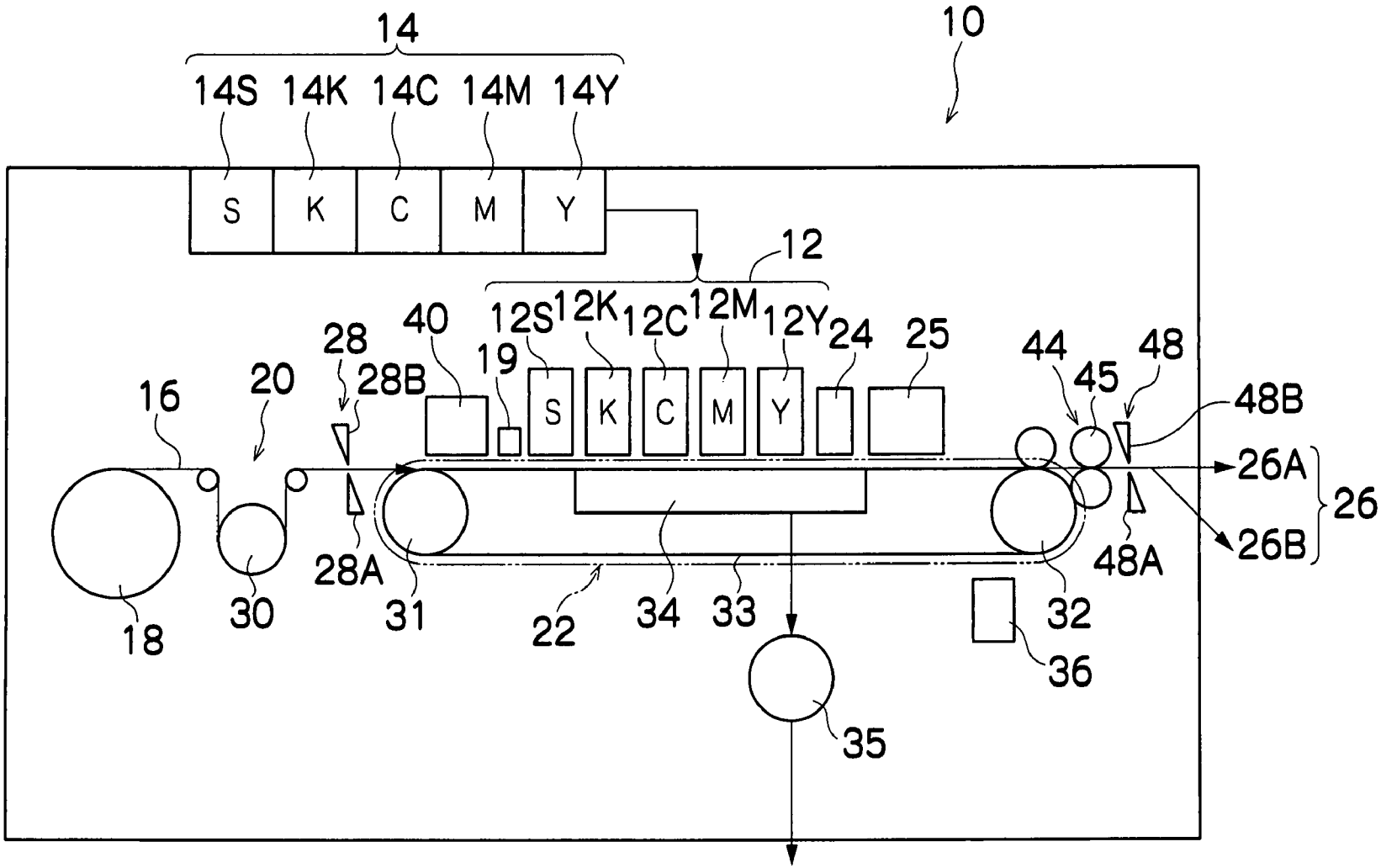
FIG. 1 is a general schematic drawing of an inkjet recording apparatus according to an embodiment of the present invention.

FIG. 1 is a diagram of the general composition of an inkjet recording apparatus according to an embodiment of the present invention. As shown in FIG. 1, this inkjet recording apparatus 10 comprises: a print unit 12 having a plurality of print heads 12K, 12C, 12M and 12Y provided for respective inks of the colors black (K), cyan (C), magenta (M) and yellow (Y), and a treatment liquid ejection head 12S, which ejects treatment liquid promoting the fixing of the ink by reacting with the ink (hereinafter, the print heads 12K, 12C, 12M and 12Y and the treatment liquid ejection head 12S are referred to generally as the heads 12A, 12K, 12C, 12M and 12Y); a storing and loading unit 14 which stores the color inks corresponding to the print heads 12K,12C, 12M and 12Y, and the treatment liquid corresponding to the treatment liquid ejection head 12S; a paper supply unit 18, which supplies a recording medium 16; a recording medium determination unit 19, which determines the type of recording medium 16; a decurling unit 20, which removes curl in the recording medium 16; a suction belt conveyance unit 22, disposed opposing the ink ejection surface of the print unit 12, which conveys the recording medium 16 while keeping the recording medium 16 flat; a print determination unit 24, which reads out the print result created by the print unit 12; a liquid removal unit 25, disposed after the print determination unit 24, which removes liquid (solvent) on the recording medium 16; and a paper output unit 26, which outputs the printed recording medium 16 (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter (a first cutter) 28 is provided as shown in FIG. 1, and the continuous paper is cut to a desired size by the cutter 28. The cutter 28 has a stationary blade 28A, whose length is not less than the width of the conveyor pathway of the recording medium 16, and a circular blade 28B, which moves along the stationary blade 28A. The stationary blade 28A is disposed on the reverse side of the printed surface of the recording medium 16, and the circular blade 28B is disposed on the side adjacent to the printed surface across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The inkjet recording apparatus 10 is provided with the recording medium determination unit 19, which determines the type of recording medium 16, on the upstream side of the print unit 12. Although described in more detail later (see FIG. 3), the recording medium determination unit 19 comprises a thickness sensor, which determines the thickness of the recording medium 16, and a surface characteristics sensor, which determines the surface characteristics (smoothness) of the recording medium 16. The thickness sensor and the surface characteristics sensor are not shown in FIG. 1, but are denoted with the reference numerals 120 and 122 in FIG. 3. If the above-described information recording body contains the information such as thickness information and surface characteristics information relating to the recording medium 16 to be obtained by the recording medium determination unit 19, then the recording medium determination unit 19 can be omitted.

The recording medium 16 delivered from the paper supply unit 18 retains curl due to having been loaded in the magazine. In order to remove the curl, heat is applied to the recording medium 16 in the decurling unit 20 by a heating drum 30 in the direction opposite from the curl direction in the magazine. The heating temperature at this time is preferably controlled so that the recording medium 16 has a curl in which the surface on which the print is to be made is slightly round outward.

The decurled and cut recording medium 16 is delivered to the suction belt conveyance unit 22. The suction belt conveyance unit 22 has a configuration in which an endless belt 33 is set around rollers 31 and 32 so that the portion of the endless belt 33 facing at least the ink (treatment liquid) ejection face of the printing unit 12 and the sensor face of the print determination unit 24 forms a horizontal plane (flat plane).

The belt 33 has a width that is greater than the width of the recording medium 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording medium 16 on the belt 33 is held by suction.

The belt 33 is driven in the clockwise direction in FIG. 1 by the motive force of a motor 88 (not shown in FIG. 1, but shown in FIG. 7) being transmitted to at least one of the rollers 31 and 32, which the belt 33 is set around, and the recording medium 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a liquid absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the above-described suction belt conveyance is preferable, in which nothing comes into contact with the image surface in the printing area where the recording medium 16 opposes the heads 12S, 12K, 12C, 12M and 12Y and receives ejected droplets of the treatment liquid and the ink.

A heating fan 40 is disposed on the upstream side of the printing unit 12 in the conveyance pathway formed by the suction belt conveyance unit 22. The heating fan 40 blows heated air onto the recording medium 16 to heat the recording medium 16 immediately before printing so that the ink deposited on the recording medium 16 dries more easily.

Figure 2:
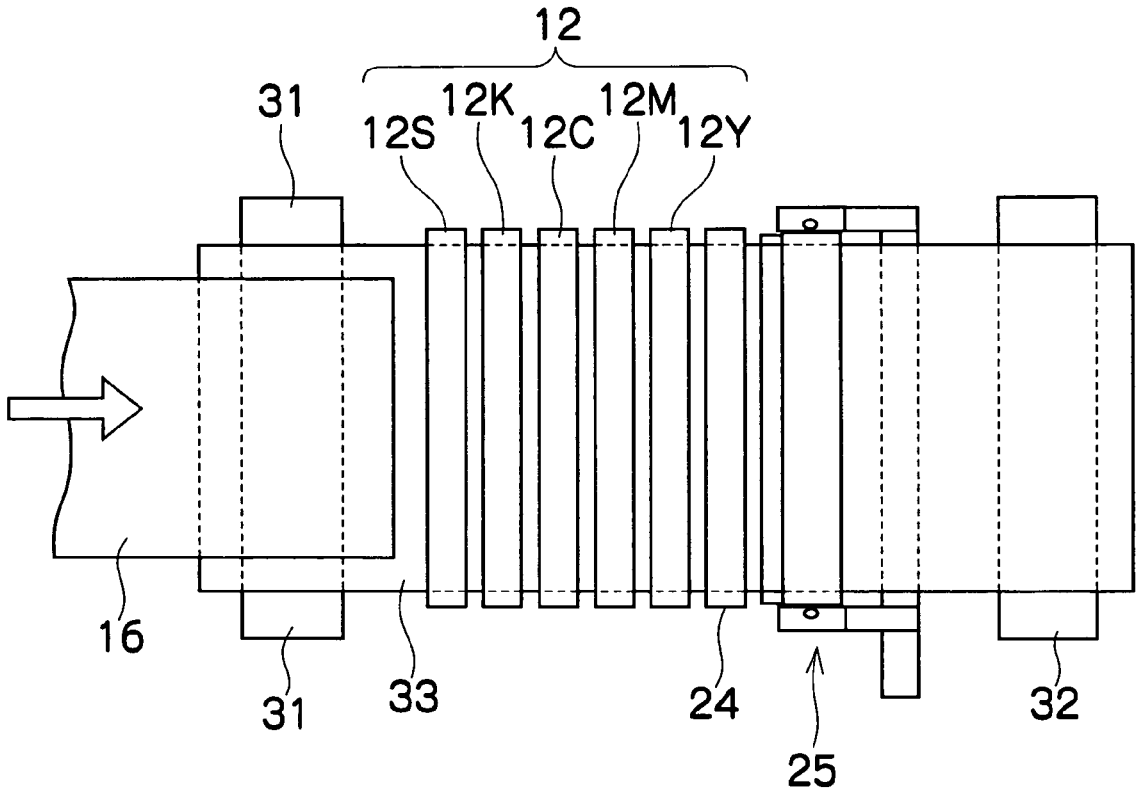
FIG. 2 is a principal plan diagram of the peripheral area of a print unit in the inkjet recording apparatus shown in FIG. 1.

The print unit 12 is a so-called "full line head" in which a line head having a length corresponding to the maximum paper width is arranged in a direction that is perpendicular to the paper feed direction (see FIG. 2). An example of the detailed structure is described later, and each of the heads 12S, 12K, 12C, 12M, and 12Y is constituted by a line head, in which a plurality of nozzles are arranged along a length that exceeds at least one side of the maximum-size recording medium 16 intended for use in the inkjet recording apparatus 10, as shown in FIG. 2.

The heads are arranged in the order of the treatment liquid ejection head 12S corresponding to the treatment liquid (S), and the print heads 12K, 12C, 12M, and 12Y corresponding to the respective color inks of black (K), cyan (C), magenta (M), and yellow (Y) from the upstream side, following the feed direction of the recording medium 16 (hereinafter, referred to as the paper feed direction). A color print can be formed on the recording medium 16 by ejecting treatment liquid from the treatment liquid ejection head 12S and by ejecting color inks respectively from the print heads 12K, 12C, 12M, and 12Y, onto the recording medium 16 onto which treatment liquid has been deposited (in other words, onto the treatment liquid), while conveying the recording medium 16.

The print unit 12, in which the full-line heads covering the entire width of the paper are thus provided for the respective ink colors, can record an image over the entire surface of the recording medium 16 by performing the action of moving the recording medium 16 and the print unit 12 relatively to each other in the sub-scanning direction just once (in other words, by means of a single sub-scan). Higher-speed printing is thereby made possible and productivity can be improved in comparison with a shuttle type head configuration in which a head moves reciprocally in the main scanning direction.

Although a configuration with the KCMY four standard colors is described in the present embodiment, the combinations of the ink colors and the number of colors are not limited to these, and light and/or dark inks can be added as required. For example, a configuration is possible in which print heads for ejecting light-color inks such as light cyan and light magenta are added.

As shown in FIG. 1, the storing and loading unit 14 comprises a treatment liquid tank 14S, which stores the treatment liquid corresponding to the treatment liquid ejection head 12S, and ink supply tanks 14K, 14C, 14M and 14Y, which store color inks corresponding to the respective print heads 12K, 12C, 12M, 12Y. The tanks are connected to the heads 12S, 12K, 12C, 12M and 12Y, through prescribed tubing channels (not shown).

Furthermore, the ink storing and loading unit 14 also comprises a warning device (for example, a display device or an alarm sound generator) for warning when the remaining amount of any of treatment liquid and ink is low, and has a mechanism for preventing loading errors between inks of different colors and between the inks and treatment liquid.

The print determination unit 24 has an image sensor for capturing an image of the print result of the printing unit 12, and functions as a device to check for ejection defects such as clogs of the nozzles in the printing unit 12 from the image read by the image sensor.

The print determination unit 24 of the present embodiment is configured with at least a line sensor having rows of photoelectric transducing elements with a width that is greater than the width (printable width) of the treatment liquid and ink ejection of the heads 12S, 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the heads 12S, 12K, 12C, 12M, and 12Y, and the ejection of each heads 12S, 12K, 12C, 12M, and 12Y is determined. The ejection determination includes the presence of the ejection, measurement of the dot size, and measurement of the dot deposition position.

The liquid removal unit 25, which removes the un-reacted treatment liquid remaining on the recording medium 16 and the ink solvent remaining on the recording medium 16, is disposed at a stage after the print determination unit 24 (on the downstream side thereof in terms of the paper feed direction). The details of the liquid removal unit 25 are described later.

A heating and pressurizing unit 44 is provided at a stage following the liquid removal unit 25. The heating and pressurizing unit 44 is a device which dries the recording medium 16 and serves to control the luster of the image surface. It applies pressure to the image surface by means of pressure rollers 45 having prescribed surface indentations, while heating same, and hence an undulating form is transferred to the image surface.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The printed matter generated in this manner is output from the paper output unit 26. The target print and the test print are preferably output separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Description of Liquid Removal Unit

Figure 3:
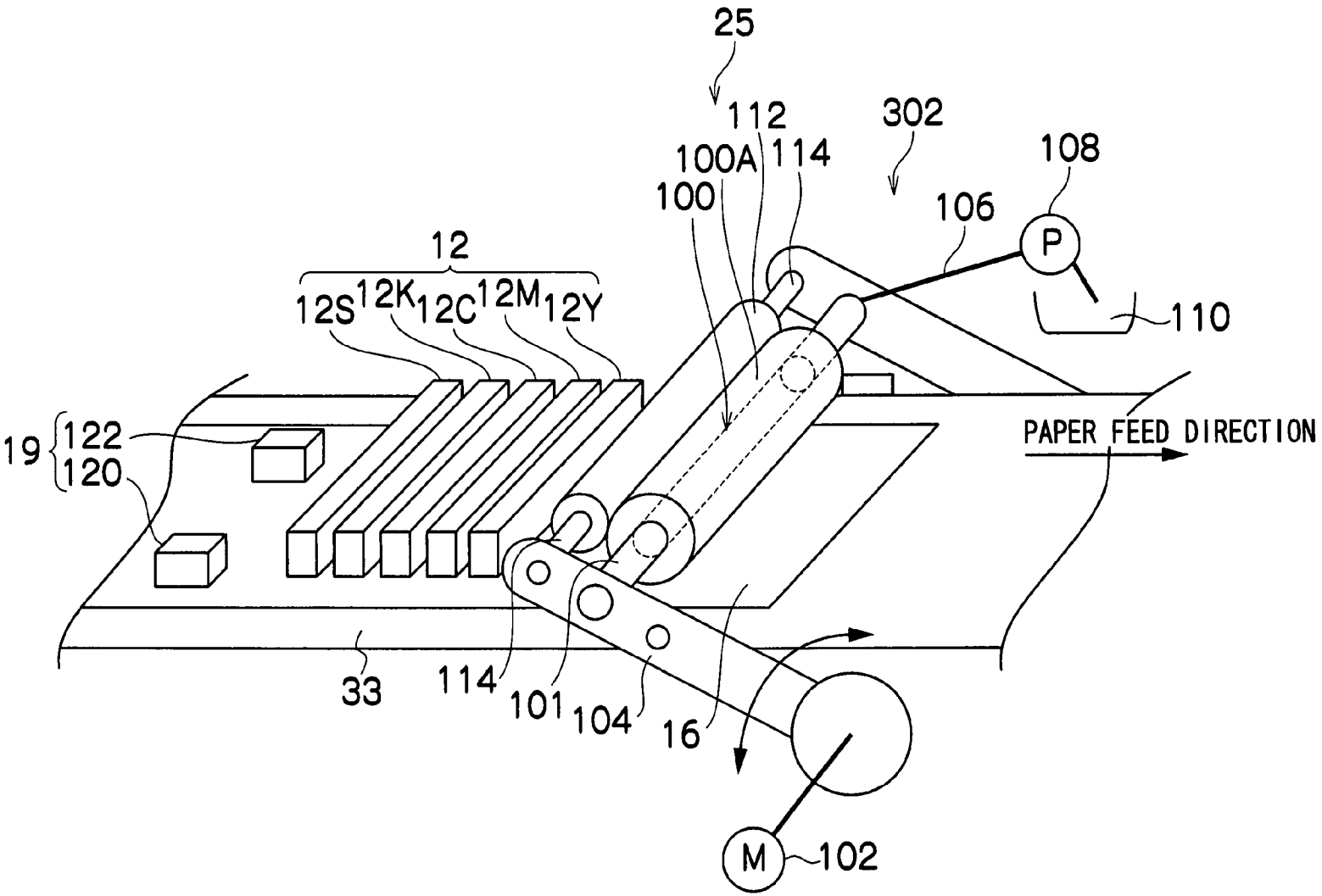
FIG. 3 is a principal schematic drawing of a liquid removal unit in the inkjet recording apparatus.

Next, the liquid removal unit 25 is described in detail with reference to FIG. 3. FIG. 3 is a principal schematic drawing of the liquid removal unit 25.

As shown in FIG. 3, the liquid removal unit 25 comprises: an absorbing roller 100 having a length corresponding to the breadthways dimension of the recording medium 16 in the direction substantially perpendicular to the paper feed direction (a length substantially equal to or greater than the full width of the recording medium 16); a pressing arm 104, which supports the absorbing roller 100 through a supporting member 101 coupled to both ends of the absorbing roller 100 and is driven by a drive source 102 so as to vary the distance between the absorbing roller 100 and the recording medium 16 (in such a manner that the absorbing roller 100 is moved in a substantially perpendicular direction to the recording surface of the recording medium 16); a suction device (pump) 108, which suctions the liquid absorbed by the absorbing roller 100 (and accommodated inside the absorbing roller 100), through a tube 106; a liquid receptacle 110, which receives the liquid suctioned from the absorbing roller 100 through the suction device 108; and a cleaning roller 112, which abuts against the absorbing roller 100 and removes ink coloring material and foreign matter adhering to the surface of the absorbing roller 100, and liquid or solid matter (foreign matter) adhering to the surface of absorbing roller 100.

The absorbing roller 100 has a liquid contacting section 100A, which makes contact with the liquid on the recording medium 16 and is constituted by a metal pipe having a plurality of holes (suction holes) of 100 μm diameter. The liquid on the recording medium 16 is suctioned and removed by generating a negative pressure in the liquid contacting section 100A by the suction device 108. In a mode where the liquid on the recording medium 16 is suctioned and removed in this manner, it is possible to control the liquid absorption capability (for example, the volume of liquid removed by the absorbing roller 100 per unit time), by altering the negative pressure generated by the suction device 108. A mode is also possible in which the liquid contacting section 100A is made of a member having excellent liquid absorbing properties, such as a hydrophilic porous member, nonwoven cloth, polyvinyl alcohol (PVA), polyurethane material, or the like, and the liquid on the recording medium 16 (mainly, the ink solvent and the treatment liquid solvent) is suctioned and removed into the liquid contacting section 100A, by capillary action. However, if the hydrophilic porous member, or the like, is used for the liquid contacting section 100A of the absorbing roller 100, then it is necessary to pay attention to the liquid absorption capability (the suction force). If a member having an excessively high liquid absorption capability is used, then because of this liquid absorption capability, the ink coloring material may become detached from the recording medium 16 due to the flow of liquid, and attached to the liquid contacting section 100A of the absorbing roller 100. Therefore, desirably, the liquid contacting section 100A of the absorbing roller 100 is made of a member having no or weak liquid absorption properties, and the absorption capability is controlled precisely by means of an externally connected pump, or the like.

The absorbing roller 100 has a hollow structure, and the hollow portion thereof is connected to the suction device 108 by means of a tube 106. By operating the suction device 108 and generating a negative pressure in the hollow portion, the liquid suctioned and removed from the recording medium 16 by the absorbing roller 100 is expelled to the liquid receptacle 110.

The absorbing roller 100 is constituted rotatably about an axis of rotation formed by the supporting member 101, by means of a rotating mechanism (not shown). More specifically, when executing liquid removal, the absorbing roller 100 is rotated while the absorbing roller 100 makes contact with the liquid on the recording medium 16 (or with the recording medium 16 itself).

For the drive source 102 which drives the pressing arm 104 that varies the position of the absorbing roller 100 in the thickness direction of the recording medium 16, it is suitable to use a motor (motion actuator) compatible with positional control (control of the amount of rotation), such as a stepping motor, servo motor, or the like. The amount of movement of the pressing arm 104 is controlled by governing the drive signal supplied to the drive source 102, and the distance (clearance) between the absorbing roller 100 and the recording medium 16 is varied. For example, if the thickness of the recording medium 16 changes, then the pressing arm 104 is operated and the absorbing roller 100 is moved in the thickness direction of the recording medium 16. In this way, the pressing arm 104 is controlled in such a manner that the distance between the absorbing roller 100 and the image forming surface of the recording medium 16 (or the pressure of the absorbing roller 100 against the recording medium 16) is kept uniform.

The cleaning roller 112 has substantially the same length as the absorbing roller 100 in the breadthways direction of the recording medium 16, and either end section thereof is supported by the pressing arm 104 through the supporting member 114. If a porous member, or the like, is used for the liquid contacting section 100A of the absorbing roller 100, then a member having greater permeability than the liquid contacting section 100A is used for the cleaning roller 112.

The cleaning roller 112 is constituted in such a manner that it can be moved between a cleaning position where it makes contact with the absorbing roller 100, and a withdrawal position where it does not make contact with the absorbing roller 100, by means of a movement mechanism (not shown). When carrying out the cleaning of the absorbing roller 100, the cleaning roller 112 is moved to the cleaning position, and when not carrying out the cleaning of the absorbing roller 100, the cleaning roller 112 is moved to the withdrawal position. Furthermore, the cleaning roller 112 is composed in such a manner that it can idly rotate about the supporting member 114, which forms an axis of rotation.

A blade-shaped member can be used instead of the cleaning roller, and the liquid or solid matter, such as ink coloring material, adhering to the surface of the liquid contacting section 100A can be removed by sliding this blade over the liquid contacting section 100A. Furthermore, in a mode where the liquid contacting section 100A of the absorbing roller 100 is constituted by an absorbing member, desirably, a liquid content meter for determining the amount of liquid contained in the absorbing roller 100 (and more particularly, the liquid contacting section 100A) is provided. A composition may be adopted in which the liquid content information obtained by this liquid content meter is stored in a storage medium, such as a memory, and the time for cleaning or replacing the absorbing roller 100 is estimated on the basis of the liquid content information stored in this memory.

The thickness sensor 120, which measures the thickness of the recording medium 16, and the surface characteristics sensor 122, which determines the surface characteristics of the recording medium 16, are arranged on the upstream side of the absorbing roller 100 in terms of the paper feed direction. The thickness sensor 120 and the surface characteristics sensor 122 are incorporated into the recording medium determination unit 19 shown in FIG. 1. It is possible to use commonly known technology for the method of measuring the thickness and determining the surface characteristics of the recording medium 16 (the surface smoothness of the recording medium 16), by means of the thickness sensor 120 and the surface characteristics sensor 122. For example, in order to determine the surface characteristics of the recording medium 16, a mode is possible which uses a sensor having a light emitting section that irradiates light onto the recording medium 16 and a light receiving section that receives reflected light from the recording medium 16, the surface characteristics of the recording medium 16 being determined on the basis of the information, such as the light quantity and wavelength, measured by the light receiving section.

Structure of Head

Next, the structure of the heads 12S, 12K, 12C, 12M, and 12Y is described. The heads 12S, 12K, 12C, 12M and 12Y have the same structure, and a reference numeral 50 is hereinafter designated to any of the heads.

Figure 4A:
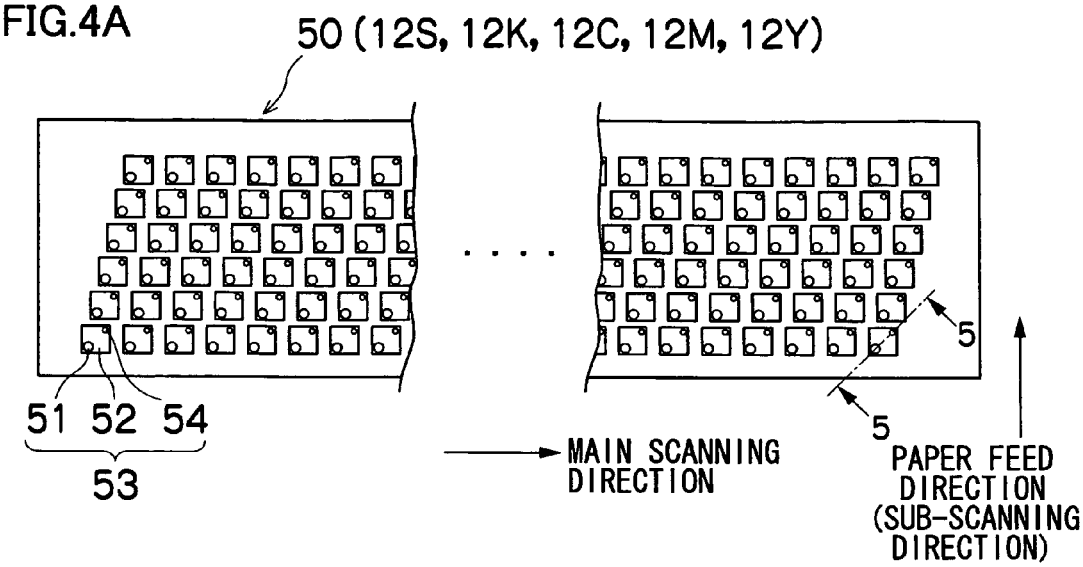
FIGS. 4A to 4C are plan view perspective diagrams showing embodiments of the composition of a print head.
Figure 4B:
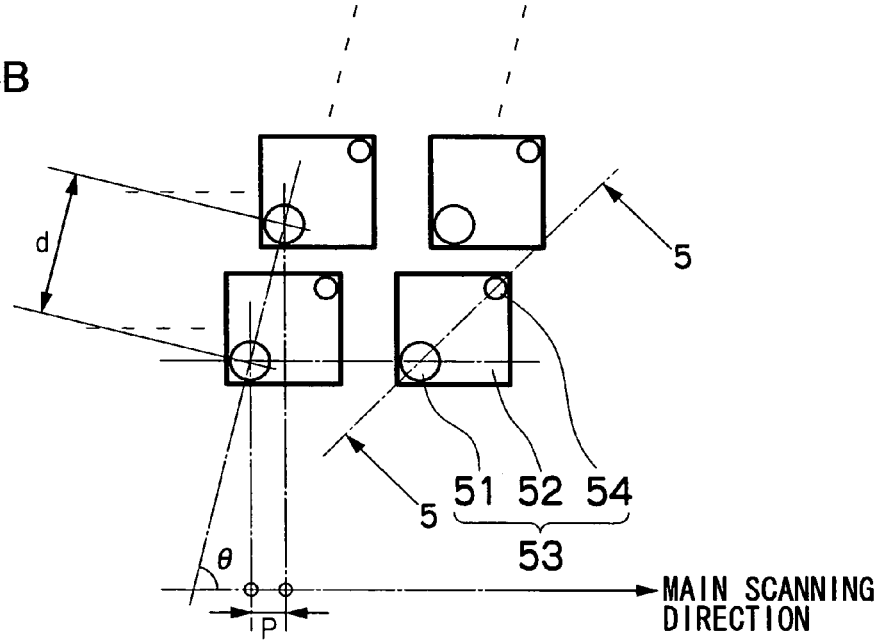
Figure 4C:
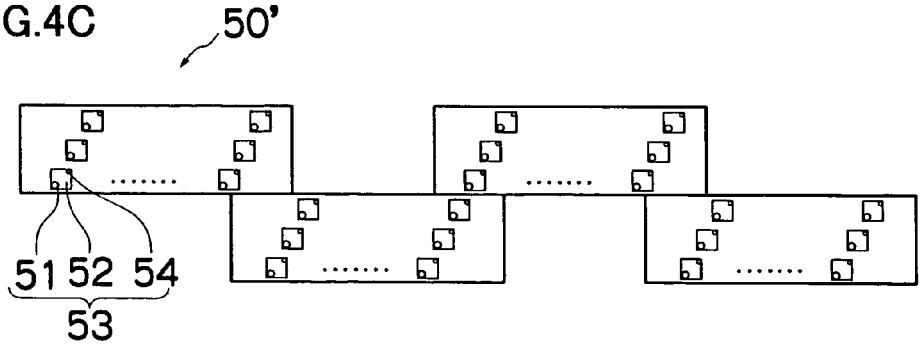
Figure 5:
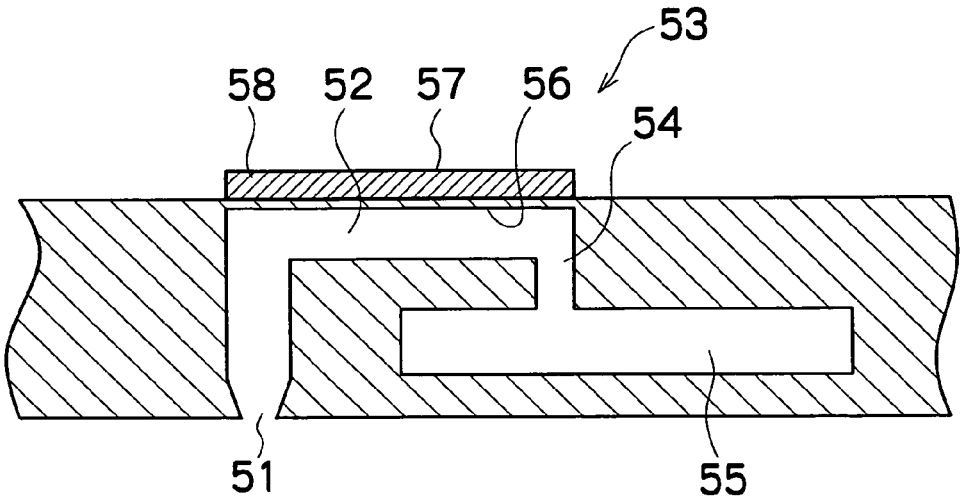
FIG. 5 is a cross-sectional view along line 5-5 in FIGS. 4A and 4B.

FIG. 4A is a plan view perspective diagram showing an example of the structure of a head 50, and FIG. 4B is an enlarged diagram of a portion of same. Furthermore, FIG. 4C is a plan view perspective diagram showing a further example of the composition of a print head 50, and FIG. 5 is a cross-sectional diagram showing a three-dimensional composition of an ink chamber unit (being a cross-sectional view along line 5-5 in FIGS. 4A and 4B). In order to achieve a high resolution of dots printed on the surface of the recording medium, it is necessary to achieve a high density of the nozzles in the print head 50. As shown in FIGS. 4A to 5, the print head 50 in the present embodiment has a structure in which a plurality of ink chamber units 53 including nozzles 51 for ejecting ink droplets and pressure chambers 52 connecting to the nozzles 51 are disposed in the form of a staggered matrix, and the effective nozzle pitch is thereby made small (the nozzle density is made high).

More specifically, as shown in FIGS. 4A and 4B, the print head 50 according to the present embodiment is a full-line head having one or more nozzle rows in which the plurality of nozzles 51 for ejecting ink are arranged through a length corresponding to the entire width (printable width) of the recording medium 16 in a direction substantially perpendicular to the paper feed direction.

Moreover, as shown in FIG. 4C, it is also possible to use heads 50' of nozzles arranged to a short length in a two-dimensional fashion, and to combine same in a zigzag arrangement, whereby a length corresponding to the full width of the recording medium is achieved.

Since it is sufficient that the treatment liquid is applied to the recording medium 16 in a substantially uniform (even)

fashion in the region where ink droplets are to be ejected, then it is not necessary to form dots of the treatment liquid to a high density, in comparison with the ink. Consequently, it is possible that the treatment liquid ejection head 12S is composed with a reduced number of nozzles (a reduced nozzle density) in comparison with the print heads 50 (12K, 12C, 12M and 12Y) for ejecting ink. Furthermore, a composition may also be adopted in which the nozzle diameter of the treatment liquid ejection head 12S is greater than the nozzle diameter of the print heads 50 for ejecting ink.

As shown in FIG. 5, the pressure chamber 52 provided correspondingly to each of the nozzles 51 is approximately square-shaped in plan view, and the nozzle 51 and a supply port 54 are provided respectively at corners on a diagonal of the pressure chamber 52. Each pressure chamber 52 is connected through the supply port 54 to a common flow channel 55.

A piezoelectric element 58 provided with an individual electrode 57 is bonded to a pressure plate (diaphragm) 56, which forms the upper faces of the pressure chambers 52. When a drive voltage is applied between the individual electrode 57 and a common electrode, as which the pressure plate 56 also serves, the piezoelectric element 58 deforms, thereby changing the volume of the pressure chamber 52. This causes a pressure change which results in ink being ejected from the nozzle 51. When ink is ejected, new ink is supplied to the pressure chamber 52 from the common flow channel 55 through the supply port 54. The structure of the ink chamber unit 53 shown in FIG. 5 is merely one example, and it is of course also possible to use another structure.

As shown in FIGS. 4A and 4B, the plurality of ink chamber units 53 having this structure are arranged in a lattice arrangement, based on a fixed arrangement pattern aligned in a main scanning direction, which is the lengthwise direction of the print head 50, and an oblique direction which, rather than being perpendicular to the main scanning direction, is inclined at a fixed angle of $\theta$ with respect to the main scanning direction. By adopting a structure wherein a plurality of ink chamber units 53 are arranged at a uniform pitch d in a direction having an angle $\theta$ with respect to the main scanning direction, the pitch P of the nozzles when projected to an alignment in the main scanning direction is $d \times \cos\theta$.

More specifically, the arrangement can be treated equivalently to one in which the respective nozzles 51 are arranged in a linear fashion at uniform pitch P, in the main scanning direction. By means of this composition, it is possible to achieve a nozzle of high density, in which the nozzle columns projected to align in the main scanning direction reach a total of 2,400 per inch (2,400 nozzles per inch, 2400 dpi). Below, in order to facilitate the description, it is supposed that the nozzles 51 are arranged in a linear fashion at a uniform pitch (P), in the main scanning direction. Here, the main scanning direction shown in FIGS. 4A and 4B is substantially parallel to the sensor scanning direction shown in FIG. 3, and the sub-scanning direction shown in FIG. 4A is substantially parallel to the paper feed direction shown in FIG. 3.

In implementing the present invention, the arrangement of the nozzles is not limited to that of the embodiment illustrated. Moreover, the piezo jet method is employed in the present embodiment where an ink droplet is ejected by means of the deformation of the piezoelectric element 58; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink being ejected by means of the pressure applied by these bubbles.

Description of Ink Supply System and Treatment Liquid Supply System

Next, the treatment liquid supply system and the ink supply system of the inkjet recording apparatus 10 are described. In the present embodiment, the treatment liquid supply system and the ink supply system have the same basic composition, and are described with respect to the ink supply system shown in FIG. 6. Below, the treatment liquid supply system and the ink supply system may be referred to jointly as the "supply system".

Figure 6:
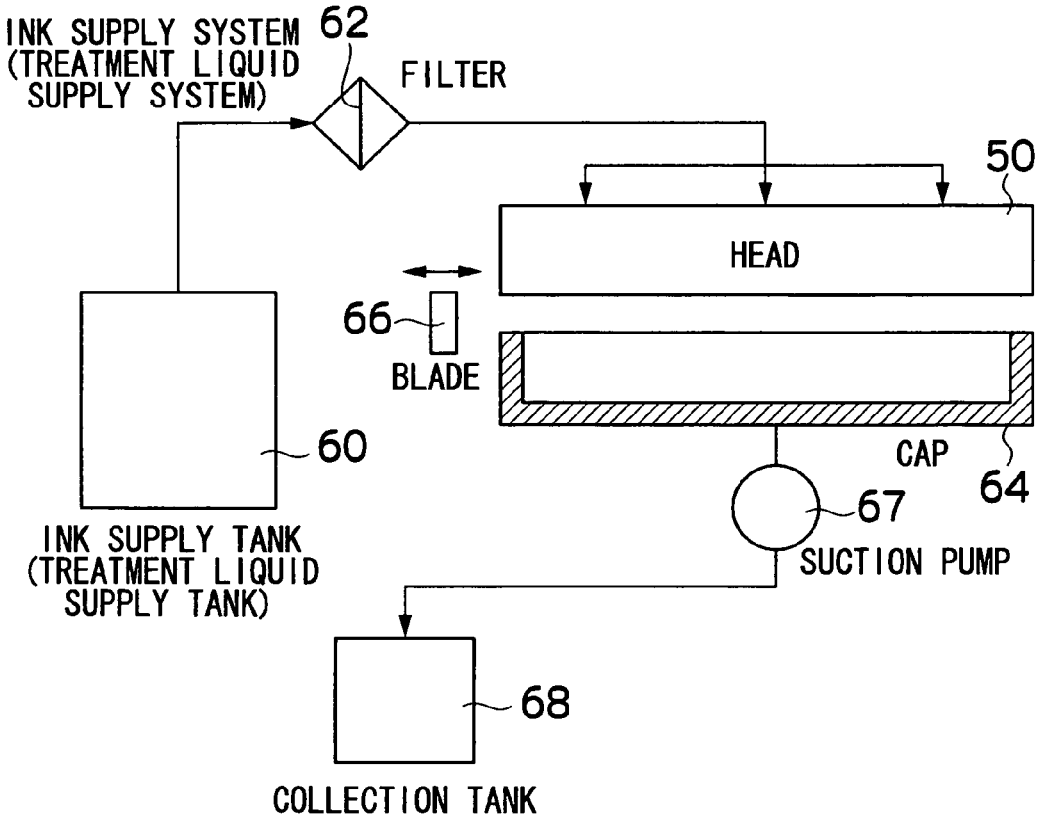
FIG. 6 is a principal block diagram showing the configuration of a supply system in the inkjet recording apparatus.

FIG. 6 shows the composition of an ink supply system provided in the inkjet recording apparatus 10. The ink supply system shown in FIG. 6 corresponds to the storing and loading unit 14 shown in FIG. 1.

An ink supply tank (treatment liquid supply tank) 60 forming a base tank for supplying ink (treatment liquid) is disposed in the ink supply system shown in FIG. 6. The ink supply tank 60 may adopt a system for replenishing ink by means of a replenishing opening (not shown), or a cartridge system wherein cartridges are exchanged independently for each tank, whenever the residual amount of ink has become low. If the type of ink is changed in accordance with the type of application, then a cartridge based system is suitable. In this case, desirably, type information relating to the ink is identified by means of a bar code, or the like, and the ejection of the ink is controlled in accordance with the ink type.

Furthermore, the ink in the ink supply tank 60 is supplied to the head 50 through prescribed tubing channels (not shown) and a filter 62, in order to remove foreign matter and air bubbles. The filter mesh size in the filter 62 is preferably equivalent to or less than the diameter of the nozzle and is commonly about 20 μm.

Although not shown in FIG. 6, it is preferable to provide a sub-tank integrally to the head 50 or nearby the head 50. The sub-tank has a damper function for preventing variation in the internal pressure of the head 50 and a function for improving refilling of the print head.

The inkjet recording apparatus 10 is also provided with a cap 64 as a device to prevent the nozzles 51 from drying out or to prevent an increase in the ink and treatment liquid viscosity in the vicinity of the nozzles 51, and a cleaning blade 66 as a device to clean the nozzle face.

A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is moved up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face is thereby covered with the cap 64.

During printing or standby, if the use frequency of a particular nozzle 51 is low, and if it continues in a state of not ejecting ink or treatment liquid for a prescribed time period or more, then the solvent of the ink or treatment liquid in the vicinity of the nozzle evaporates and the viscosity of the ink or treatment liquid increase. In a situation of this kind, it will become impossible to eject ink or treatment liquid from the nozzle 51, even if the piezoelectric element 58 is operated. Therefore, before a situation of this kind develops (while the ink or treatment liquid is within a range of viscosity which allows it to be ejected by operation of the piezoelectric element 58), the piezoelectric element 58 is operated, and a preliminary ejection ("purge", "blank ejection", "liquid ejection" or "dummy ejection") is carried out toward the cap (ink receptacle), in order to expel the degraded ink or treatment liquid (namely, the ink or treatment liquid in the vicinity of the nozzle which has increased in viscosity).

Furthermore, if air bubbles enter into the ink or treatment liquid inside the head 50 (inside the pressure chamber 52), then even if the piezoelectric element 58 is operated, it will not be possible to eject the ink or treatment liquid from the nozzle. In a case of this kind, the cap 64 is placed on the head 50, the ink or treatment liquid (the ink or treatment liquid containing air bubbles) inside the pressure chamber 52 is removed by suction, by means of a suction pump 67, and the ink or treatment liquid removed by suction is then sent to a collection tank 68.

This suction operation is also carried out in order to remove degraded ink or treatment liquid having increased viscosity (hardened ink or treatment liquid), when ink or treatment liquid is loaded into the head for the first time, and when the head starts to be used after having been out of use for a long period of time. Since the suction operation is carried out with respect to all of the ink or treatment liquid inside the pressure chambers 52, the ink or treatment liquid consumption is considerably large. Therefore, desirably, preliminary ejection is carried out when the increase in the viscosity of the ink or treatment liquid is still minor.

The cleaning blade 66 is composed of rubber or another elastic member, and can slide on the ink ejection surface (surface of the nozzle plate) of the head 50 by means of a blade movement mechanism (wiper) (not shown). When ink droplets or foreign matter has adhered to the nozzle plate, the surface of the nozzle plate is wiped and cleaned by sliding the cleaning blade 66 on the nozzle plate. When the soiling on the ink ejection surface is cleaned away by the blade mechanism, a preliminary ejection is also carried out in order to prevent the foreign matter from becoming mixed inside the nozzle 51 by the blade.

Description of Control System

Figure 7:
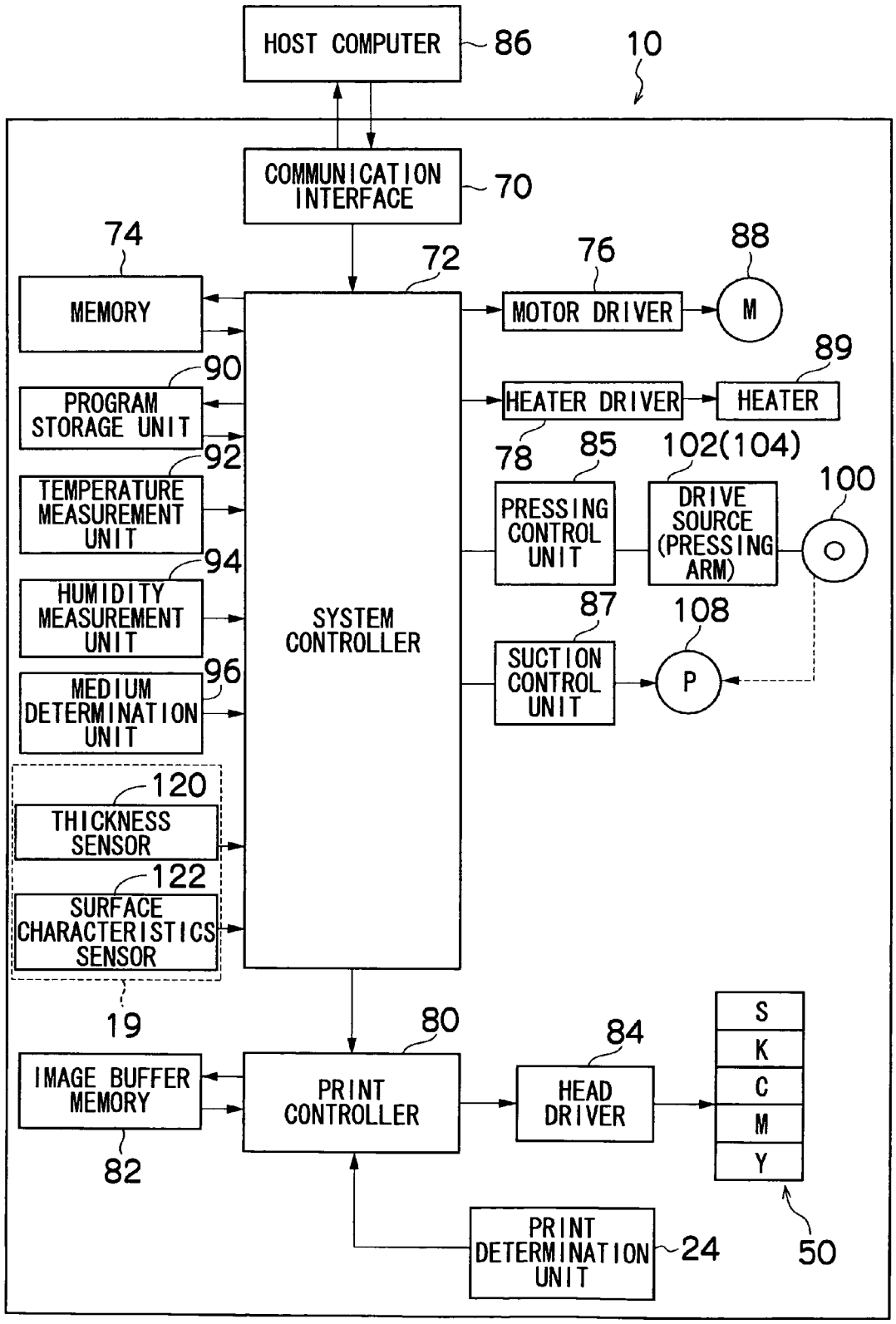
FIG. 7 is a principal block diagram showing the system configuration of the inkjet recording apparatus.

FIG. 7 is a principal block diagram showing the system configuration of the inkjet recording apparatus 10. The inkjet recording apparatus 10 comprises a communication interface 70, a system controller 72, a memory 74, a motor driver 76, a heater driver 78, a print controller 80, an image buffer memory 82, a head driver 84, a pressing control unit 85, a suction control unit 87, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the memory 74.

The memory 74 is a storage device for temporarily storing images input through the communication interface 70, and data is written and read to and from the image memory 74 through the system controller 72. The memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, memory 74, motor driver 76, heater driver 78, pressing control unit 85, and the like, as well as controlling communications with the host computer 86 and writing and reading to and from the memory 74, and it also generates control signals for controlling the motor 88 and heater 89 of the conveyance system.

The motor driver 76 drives the motor 88 in accordance with commands from the system controller 72. The heater driver 78 drives the heater 89 of the heating fan 40 or the like in accordance with commands from the system controller 72.

FIG. 7 shows only one motor 88, but in practice, a plurality of motors (motion actuators) are provided, such as a drive motor for the suction belt conveyance unit 22, the motors of the rotational mechanism and movement mechanism of the absorbing roller 100, and the like. Furthermore, a plurality of motor drivers 76 are provided for controlling the plurality of motors 88. Of course, it is also possible to integrate all or a portion of the plurality of motor drivers.

The print controller 80 has a signal processing function for performing various tasks, compensations, and other types of processing for generating print control signals from the image data stored in the memory 74 in accordance with commands from the system controller 72 so as to supply the generated print data to the head driver 84. Prescribed signal processing is carried out in the print controller 80, and the ejection amount and the ejection timing of the ink droplets and treatment liquid from the respective print heads 50 are controlled through the head driver 84.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 generates a drive signal on the basis of print data supplied by the print controller 80, and drives the piezoelectric elements of the heads 12S, 12K, 12C, 12M and 12Y, on the basis of this drive signal. A feedback control system for maintaining constant drive conditions in the head may be included in the head driver 84.

The pressing control unit 85 generates a drive signal (pulse signal) on the basis of a command signal supplied by the system controller 72, and drives the drive source 102 of the pressing arm 104 by means of this drive signal. More specifically, a positional control type of motor, such as a stepping motor, servo motor, or the like, is used for the drive source 102, and the amount of movement of the pressing arm 104 is governed by means of the number of pulses of the pulse signal (the movement amount information in the drive signal).

The image data to be printed is externally (for example, from the host computer 86) input through the communication interface 70, and is stored in the memory 74. In this stage, the RGB image data is stored in the memory 74.

The image data stored in the memory 74 is sent to the print controller 80 through the system controller 72, and is converted to the dot data for each ink color in the print controller 80. In other words, the print controller 80 performs processing for converting the input RGB image data into dot data for four colors, K, C, M and Y. The dot data generated by the print controller 80 is stored in the image buffer memory 82.

In the present embodiment, the memory 74 is shown as a storage unit attached to the system controller 72, but the memory 74 may also be constituted by a plurality of memories (storage media). Furthermore, it is also possible to incorporate the memory 74 into the system controller 72. The information stored in the memory 74 may include, in addition to the RGB image data described above, various setting information, system parameters, a threshold value table used to judge conditions, various types of data tables, corrective coefficients used for various corrections, and the like.

The suction control unit 87 controls the on and off switching of the suction device 108, and the rotational speed and rotational frequency of the suction device 108, on the basis of a control signal output from the system controller 72. By controlling the driving force of the suction device 108, through the suction control unit 87, it is possible to vary the liquid removal capability of the absorbing roller 100 shown in FIG. 3.

Various control programs are stored in a program storage section 90, and a control program is read out and executed in accordance with commands from the system controller 72. The program storage section 90 may use a semiconductor memory, such as a ROM, EEPROM, or a magnetic disk, or the like. An external interface may be provided, and a memory card or PC card may also be used. Naturally, a plurality of these storage media may also be provided.

The program storage unit 90 may also be combined with a storage device (memory) (not shown) for storing operational parameters (system parameters), and the like.

The print determination unit 24 is a block that includes the line sensor as described above with reference to FIG. 1, reads the image printed on the recording medium 16, determines the ejection conditions (presence of the ejection, variation in the dot formation, and the like) by performing desired signal processing, or the like, and provides the determination results of the print conditions to the print controller 80.

According to requirements, the print controller 80 makes various corrections with respect to the head 50 on the basis of information obtained from the print determination unit 24.

The inkjet recording apparatus 10 comprises a temperature measurement unit 92 and a humidity measurement unit 94, which measure the ambient temperature and the ambient humidity of the head 50 and the recording medium 16 in the print region. A temperature signal (temperature information) which indicates the temperature measured by the temperature measurement unit 92, and a humidity signal (humidity information) indicating the humidity measured by the humidity measurement unit 94 are sent to the system controller 72. The system controller 72 controls a temperature modification device, such as the heater 89, cooling fan (not shown), or the like, in such a manner that a prescribed (settled) temperature and humidity are maintained on the basis of the temperature signal and the humidity signal.

Furthermore, the present inkjet recording apparatus 10 comprises a recording medium determination unit 96 which determines the type of recording medium used, and implements various types of control, such as control of the distance between the absorbing roller 100 and the recording medium 16, the suction force of the suction device 108, and the ejection of treatment liquid and ink, control of the temperature and humidity in the head 50, and the like, in accordance with the type of recording medium determined by the recording medium determination unit 96. In other words, a composition is adopted wherein, when the recording medium type information obtained by the recording medium determination unit 96 is sent to the system controller 72, the system controller 72 controls the respective units on the basis of this recording medium type information.

The mode of determining the type of recording medium by means of the recording medium determination unit 96 may involve an operator inputting the prescribed recording medium type through a man-machine interface, such as a keyboard, touch panel, or the like, or the type of paper used may be determined automatically by reading in information from an information recording body, such as a barcode or wireless tag, in which paper type information is recorded, this information recording body being attached to the magazine or tray of the recording medium 16.

On the other hand, the type of recording medium 16 to be used may be determined directly by means of the recording medium determination unit 19, and the recording medium type may be judged on the basis of these determination results. The system controller 72 can obtain the thickness information and the surface properties information of the recording medium 16 through the thickness sensor 120 and the surface characteristics sensor 122 contained in the recording medium determination unit 19. In the system controller 72, the distance between the absorbing roller 100 and the recording medium 16 (the pressure exerted by the absorbing roller 100) shown in FIG. 3, for example, is controlled on the basis of the thickness information and surface properties information of the recording medium 16.

Description of Surface Properties of Absorbing Roller

Next, the surface properties of the absorbing roller 100 used in the liquid removal unit 25 of the inkjet recording apparatus 10 are described. In the inkjet recording apparatus 10 according to the present embodiment, which is based on a two-liquid system, an ink and a treatment liquid are made to react on the recording medium 16, thereby causing the ink coloring material contained in the ink to become insoluble, or to aggregate, thereby fixing the ink coloring material on the recording medium 16 and forming a dot.

If an excessive amount of the ink solvent remaining on the recording medium 16 permeates into the recording medium 16, then there is a probability that cockling is occur. Hence, the ink solvent on the recording medium 16 is removed within a prescribed time period, by the liquid removal unit 25.

When removing the ink solvent, the ink coloring material may adhere to the surface of the absorbing roller 100 when the ink coloring material makes contact with the absorbing roller 100, and hence there is a probability that the image quality may decline, due to reduced density or the like, if a portion of the ink coloring material is removed in this way from the image formed on the recording medium 16. Furthermore, if the ink coloring material which has become attached to the absorbing roller 100 comes into contact with another image (a recording medium on which another image is formed), then problems arise in that the quality of the other image also declines and the recording medium on which the other image is formed becomes soiled.

In the inkjet recording apparatus 10 according to the present embodiment, the relative surface properties of the absorbing roller 100 and the recording medium 16 are specified in such a manner that the ink coloring material does not adhere to the absorbing roller 100, even if the absorbing roller 100 makes contact with the recording medium 16 (in such a manner that even if ink coloring material adheres to the absorbing roller 100, the amount of adhering coloring material is within an acceptable range). In the present embodiment, the specified surface properties include the surface roughness, the surface free energy, and the contact angle of the ink on the surface (hereinafter, simply referred to as the "contact angle of the surface").

Figure 11A:
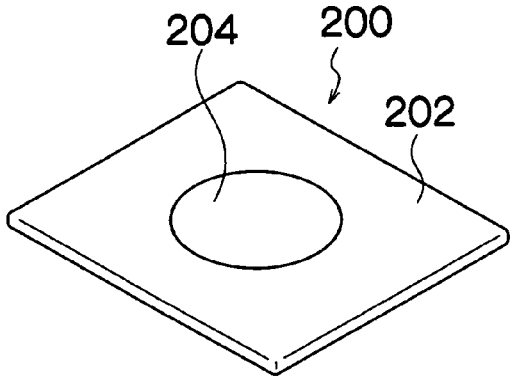
FIGS. 11A to 11C are diagrams showing experimentation for determining the relationship between the recording medium and the absorbing roller in the surface properties.
Figure 11B:
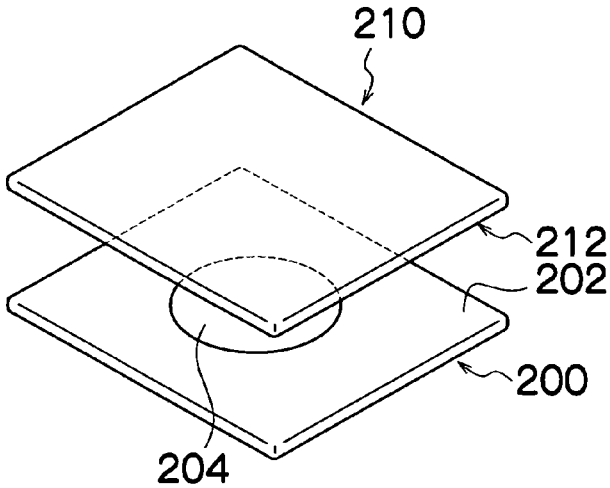
Figure 11C:
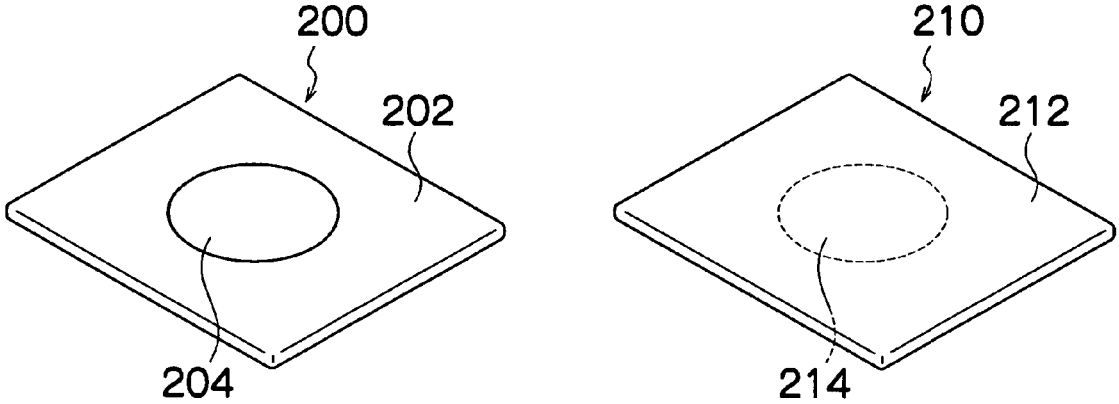

FIG. 8 shows the relationship between the absorbing roller 100 and the recording medium 16 in the surface roughness, FIG. 9 shows the relationship between the absorbing roller 100 and the recording medium 16 in the surface free energy, and FIG. 10 the relationship between the absorbing roller 100 and the recording medium 16 in the contact angle. The relationships between the absorbing roller 100 and the recording medium 16 in the surface properties shown in FIGS. 8 to 10 were obtained by means of the following experimentation. FIGS. 11A to 11C show a general overview of this experiment.

As shown in FIG. 11A, ink 204 of a prescribed amount was deposited onto an ink deposition surface 202 of a metal (stainless steel) plate 200 having specified surface properties, in a region where a treatment liquid had been deposited previously. Thereupon, as shown in FIG. 11B, a surface 212 of a metal (stainless steel) plate 210 having specified surface properties was placed in contact with the ink deposition surface 202 of the metal plate 200 on which the ink 204 had been deposited, and it was pressed against the plate 200 at a prescribed pressure. FIG. 11A does not depict the range in which the treatment liquid was deposited, but this range was a portion of the ink deposition surface 202 of the metal plate 200 or the whole of the surface.

Then, after a prescribed time period had elapsed, the metal plate 200 and the metal plate 210 were peeled apart as shown in FIG. 1 IC. Then, a visual inspection was made of the state of adherence of the ink 204 to the ink deposition surface 202 of the metal plate 200, and the state of the ink 214 adhering (transferring) to the surface 212 of the metal plate 210.

The surface roughness, surface free energy and contact angle were used as the surface properties which were specified for the metal plates 200 and 210. In a mode where the surface roughness of the respective surfaces was different, a method was used in which the surface roughness of the respective surfaces was altered by roughening up the ink deposition surface 202 of the metal plate 200 and the surface 212 of the metal plate 210, by sandblasting or the like.

The surface free energy varies with the composition of the material, the surface properties of the material, and the environmental conditions, such as the temperature and the humidity. In a mode where the contact angle was to be altered between the respective surfaces, techniques such as applying a liquid-repelling agent to the respective surfaces (liquid-repelling treatment) or forming an oxide film onto the respective surfaces by means of an oxygen plasma, or the like (hydrophilic processing) were used.

Here, the metal plate 200 used in the experiment corresponds to the recording medium 16, and the ink deposition surface 202 of the metal plate 200 corresponds to the image forming surface of the recording medium 16. Furthermore, the surface 212 of the metal plate 210 corresponds to the liquid contacting section 100A of the absorbing roller 100.

FIG. 8 shows the experimental results for a case where the surface roughness of the ink deposition surface 202 of the metal plate 200 and the surface 212 of the metal plate 210 was varied in four stages (3.00 μm, 1.73 μm, 0.99 μm and 0.09 μm). In FIG. 8, "A" indicates that no adhering ink 214 was observed, or that a slight amount of ink 214 was observed on the metal plate 210 (namely, an amount of ink 214 within a tolerable range), and "B" indicates that the amount of ink 204 adhering to the metal plate 200 was substantially the same as the amount of ink 214 adhering to the metal plate 210. Furthermore, "F" indicates that the amount of ink 214 adhering to the metal plate 210 was greater than the amount of ink 204 adhering to the metal plate 200.

As shown in FIG. 8, if, for example, the surface roughness of the metal plate 200 was 1.73 μm, and the surface roughness of the metal plate 210 was 3.00 μm (in other words, if the surface roughness of the metal plate 200 was lower than the surface roughness of the metal plate 210), then no ink adhered to the metal plate 210, or the amount of ink 214 adhering to the metal plate 210 was very small (within a tolerable range).

If, for example, the surface roughness of both the metal plate 200 and the metal plate 210 was 3.00 μm (in other words, if the metal plate 200 and the metal plate 210 had substantially the same surface roughness), then the amount of ink 204 adhering to the metal plate 200 and the amount of ink 214 adhering to the metal plate 210 were substantially the same. If the surface roughness of the metal plate 200 was 3.00 μm and the surface roughness of the metal plate 210 was 0.99 μm (in other words, if the surface roughness of the metal plate 200 was greater than the surface roughness of the metal plate 210), then the amount of ink 214 adhering to the metal plate 210 was greater than the amount of ink 204 adhering to the metal plate 200.

From the experimental results described above, it can be seen that, if the surface roughness of the metal plate 200 is lower than the surface roughness of the metal plate 210, then none of the ink deposited on the metal plate 200 adheres to the metal plate 210, or the amount of the ink transferring from the metal plate 200 to the metal plate 210 is very small and hence tolerable. This means that, if a recording medium 16 and an absorbing roller 100 satisfying the relationship "(surface roughness of recording medium)<(surface roughness of absorbing roller)" are used, then the amount of ink adhering to the absorbing roller 100 when the absorbing roller 100 makes contact with the ink on the recording medium 16 is zero or a very small amount, and there is no problem.

A more desirable mode is one which uses a recording medium 16 and an absorbing roller 100 satisfying the relationship "(surface roughness of recording medium)×2<(surface roughness of absorbing roller)", as the example in which the surface roughness of the metal plate 200 was 0.99 and the surface roughness of the metal plate 210 was 3.00.

FIG. 9 shows the experimental results of a case where the surface free energy of the ink deposition surface 202 of the metal plate 200 and the surface 212 of the metal plate 210 were varied. In FIG. 9, the symbols "A" and "F" have the same meanings as in FIG. 8. FIG. 9 shows the surface free energy per unit surface area as measured by the Owens-Wendt method, and it gives the experimental results for four different levels of surface roughness (3.00 μm, 1.73 μm, 0.99 μm and 0.09 μm).

As shown in FIG. 9, if the surface free energy of the metal plate 200 was smaller than the surface free energy of the metal plate 210, regardless of the surface roughness (as the example in which the surface free energy of the metal plate 200 was 37.6 $mJ/m^2$ and the surface free energy of the metal plate 210 was 16.4 $mJ/m^2$), then the ink deposited on the metal plate 200 did not adhere to the metal plate 210. This signifies that, if a recording medium 16 and an absorbing roller 100 satisfying the relationship "(surface free energy of recording medium)>(surface free energy of absorbing roller)" are used, then the amount of ink adhering to the absorbing roller 100 when the absorbing roller 100 makes contact with the ink on the recording medium 16 is zero or a very small amount, and there is no problem.

A more desirable mode is one which uses a recording medium 16 and an absorbing roller 100 satisfying the relationship "(surface free energy of recording medium)/2>(surface free energy of absorbing roller)".

FIG. 10 shows the experimental results of a case where the contact angles of the ink deposition surface 202 of the metal plate 200 and the surface 212 of the metal plate 210 were varied. In FIG. 10, the symbols "A", "B" and "F" have the same meanings as in FIG. 8.

As shown in FIG. 10, if the contact angle of the metal plate 200 was approximately 70 to 90 degrees (medium) and the contact angle of the metal plate 210 was approximately 100 to 120 degrees (large), or if the contact angle of the metal plate 200 was approximately 10 to 40 degrees (small) and the contact angle of the metal plate 210 was approximately 100 to 120 degrees (large), then the amount of ink 214 adhering to the metal plate 210 was greater than the amount of ink 204 adhering to the metal plate 200. If the contact angle of the metal plate 200 was approximately 10 to 40 degrees (small) and the contact angle of the metal plate 210 was approximately 70 to 90 degrees (medium), then the amount of ink 204 adhering to the metal plate 200 was substantially the same as the amount of ink 214 adhering to the metal plate 210.

If the contact angle of the metal plate 200 was approximately 70 to 90 degrees (medium) and the contact angle of the metal plate 210 was approximately 10 to 40 degrees (small), then no ink 214 adhered to the metal plate 210, or the amount of ink 214 adhering to the metal plate 210 was a very small amount (an ink amount within a tolerable range). In other words, if the contact angle of the metal plate 210 is greater than the contact angle of the metal plate 200, then none of the ink deposited on the metal plate 200 adheres to the metal plate 210, or the amount of the ink transferring from the metal plate 200 to the metal plate 210 is very small and hence tolerable. This means that, if a recording medium 16 and an absorbing roller 100 satisfying the relationship "(contact angle of recording medium)>(contact angle of absorbing roller)" are used, then the amount of ink adhering to the absorbing roller 100 when the absorbing roller 100 makes contact with the ink on the recording medium 16 is zero or a very small amount, and there is no problem. To give one embodiment of the contact angles of the recording medium 16 and the absorbing roller 100 satisfying this condition, it has been found on the basis of experimentation that particularly beneficial effects are obtained in the case of art paper having contact angle of 80 degrees, if the contact angle of the absorbing roller 100 is set in a range of 15 to 60 degrees.

A more desirable mode is one which uses a recording medium 16 and an absorbing roller 100 satisfying the relationship "(contact angle of recording medium)/2>(contact angle of absorbing roller)".

Summarizing the experimental results described above, the surface properties of the liquid contacting section 100A of the absorbing roller 100 include: "the surface roughness greater than the recording medium", "the surface free energy lower than the recording medium", "the contact angle lower than the recording medium", or "combination of any of the aforementioned conditions". By ensuring that the absorbing roller 100 has these properties, then the ink coloring material is liable to adhere to the recording medium 16, whereas the ink coloring material does not adhere readily to the absorbing roller 100. Therefore, when the absorbing roller 100 makes contact with the ink (the image formed) on the recording medium 16, the quality of the image formed on the recording medium 16 does not decline.

In the actual inkjet recording apparatus 10, the liquid absorption capability of the absorbing roller 100 is controlled by means of the suction force of the suction device 108 shown in FIG. 3. In the experimentation described above, no external force corresponding to the suction force of the suction device 108 was applied. The suction force of the suction device 108 can be set appropriately, in such a manner that conditions which do not cause the ink coloring material on the recording medium 16 to peel away are satisfied.

In the experimentation described above, one type of ink was used. However, the conditions of the surface properties of the absorbing roller 100, with respect to the recording medium 16, do not depend on the type of ink, and therefore, even if the type of ink changes, then it is sufficient that the aforementioned conditions of the surface properties of the absorbing roller 100 with respect to the recording medium 16 are satisfied.

In the inkjet recording apparatus 10 having the composition described above, since the surface properties of the absorbing roller 100 are specified in relation to the surface properties of the recording medium 16, then the adherence of ink coloring material to the absorbing roller 100 is reduced, and hence the efficiency of liquid removal on the recording medium 16 is improved, and the maintenance requirements of the liquid removal unit 25 can be reduced. Furthermore, it also becomes possible to handle media having different surface properties. The surface properties referred to here include at least one of the surface roughness, the surface free energy and the contact angle.

Adaptation Embodiment

Figure 12:
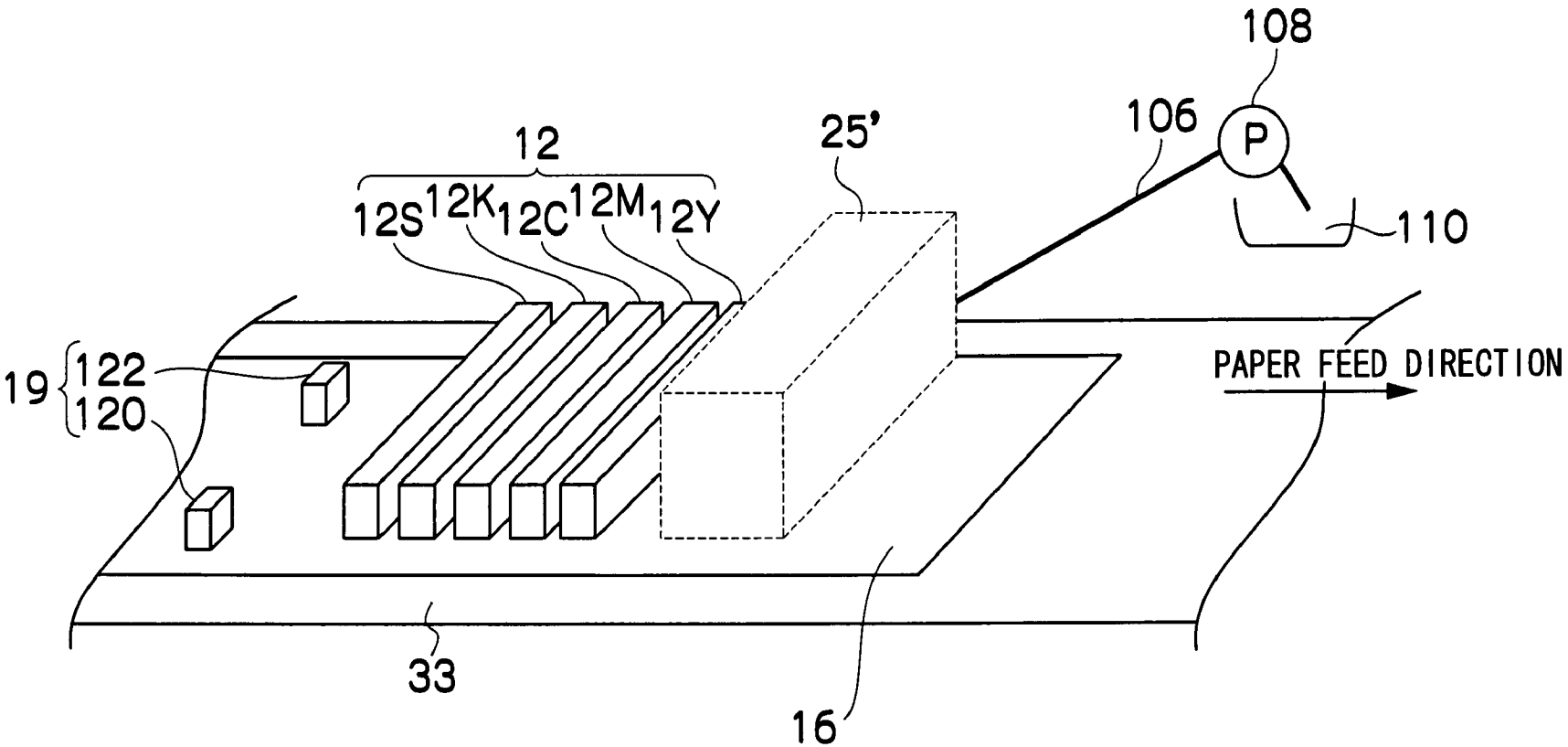
FIG. 12 is a general schematic drawing of an inkjet recording apparatus according to another embodiment of the present invention.
Figure 13:
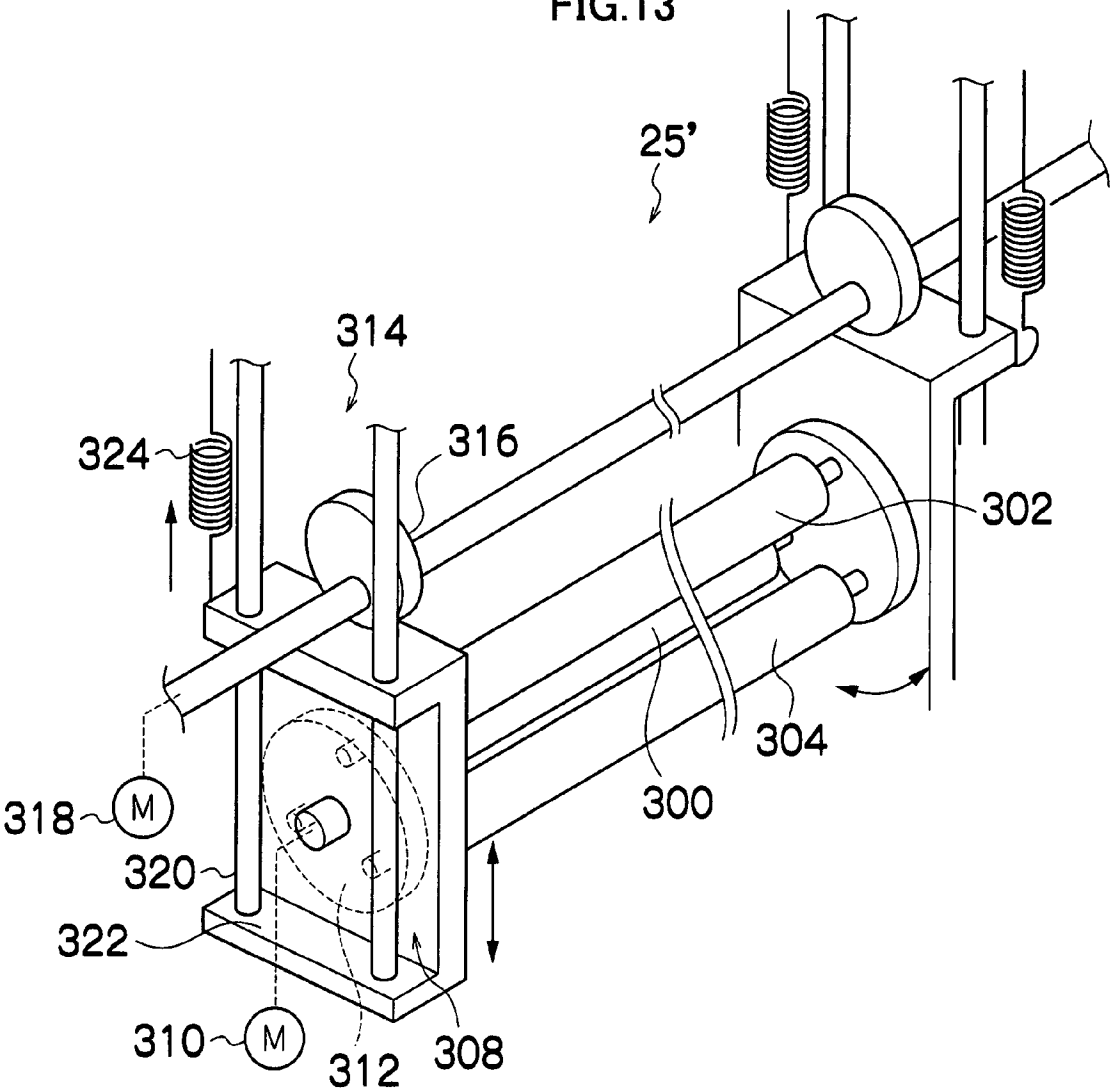
FIG. 13 is a principal schematic drawing of a liquid removal unit in the inkjet recording apparatus shown in FIG. 12.
Figure 14:
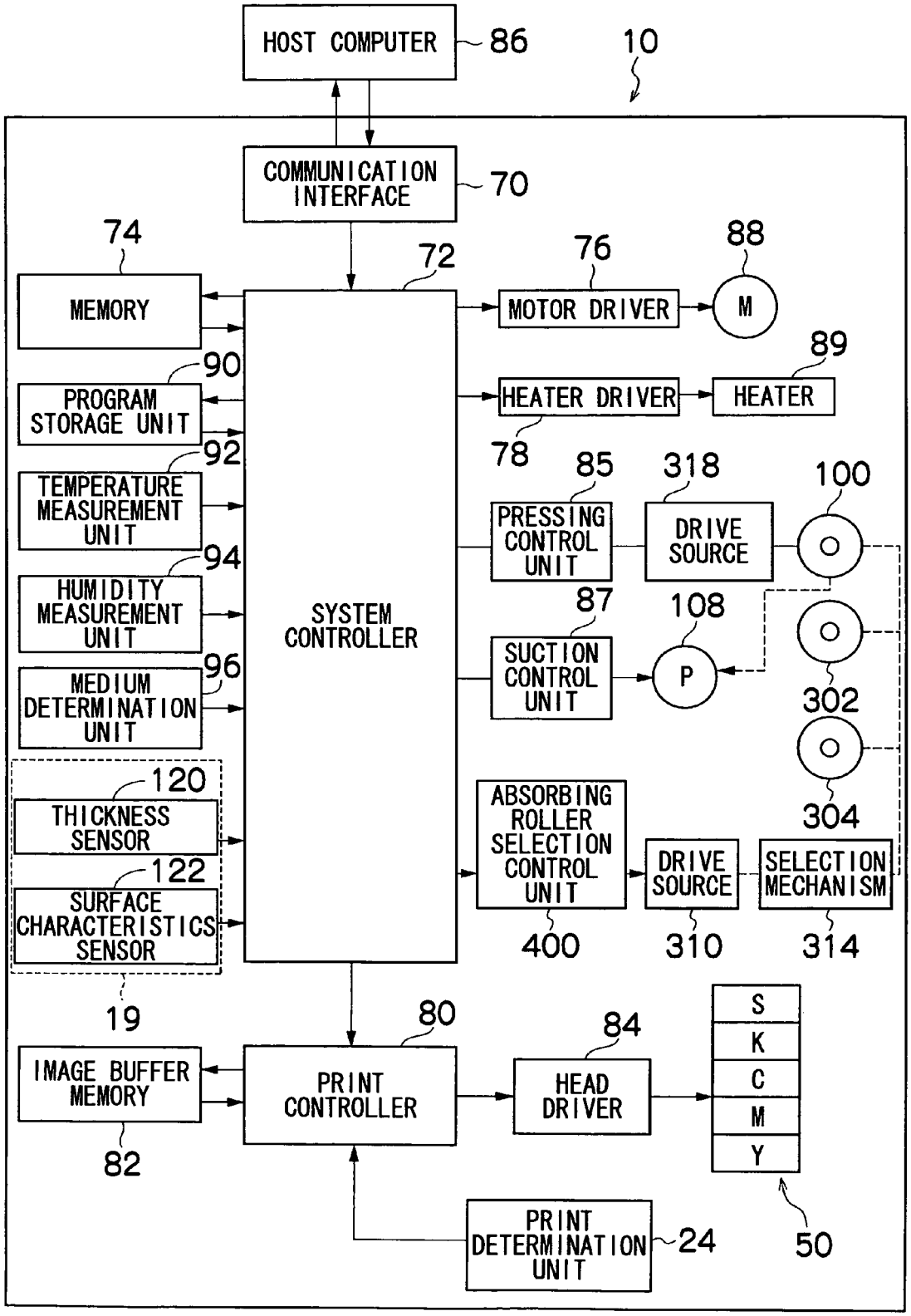
FIG. 14 is a principal block diagram showing the system configuration of the inkjet recording apparatus shown in FIG. 12.

An adaptation embodiment of the above-described inkjet recording apparatus 10 is described here with reference to FIGS. 12 to 14. FIG. 12 is a general schematic drawing of an inkjet recording apparatus according to the present embodiment, FIG. 13 is a schematic drawing showing the detailed composition of a liquid removal unit 25' in the inkjet recording apparatus shown in FIG. 12, and FIG. 14 is a block diagram showing the principal composition of a control system of the inkjet recording apparatus (FIG. 14 corresponds to FIG. 7).

The general composition of the inkjet recording apparatus shown in FIG. 12 is similar to the general composition of the inkjet recording apparatus 10 shown in FIG. 1, and here, only the features of the inkjet recording apparatus shown in FIG. 12 different from the inkjet recording apparatus 10 shown in FIG. 1 are described. The liquid removal unit 25' of the inkjet recording apparatus shown in FIG. 12 (see FIG. 13) has a different composition to the liquid removal unit 25 of the inkjet recording apparatus 10.

FIG. 13 shows the composition of the liquid removal unit 25' provided in the inkjet recording apparatus shown in FIG. 12. As shown in FIG. 13, the liquid removal unit 25' has three absorbing rollers 300, 302 and 304 having different surface properties, and these absorbing rollers 300, 302 and 304 are switched selectively by means of a selection mechanism 308. The surface properties referred to here include at least one of the surface roughness, the surface free energy and the contact angle. Furthermore, the absorbing rollers 300, 302 and 304 correspond respectively to the recording media having the highest frequency of use.

FIG. 13 shows the selection mechanism 308 switching the absorbing rollers 300, 302 and 304 by rotating a supporting plate 312 supporting ends of the absorbing rollers 300, 302 and 304, by means of a drive source (motor) 310, but the composition of the selection mechanism 308 is not limited to this and other compositions may be adopted.

The liquid removal unit 25' has an elevator mechanism 314, which raises and lowers the absorbing rollers 300, 302 and 304. The elevator mechanism 314 comprises an eccentric cam 316, a motor 318 to drive the eccentric cam 316, and a guide member 322, which moves upward and downward, by sliding along rails 320, in accordance with the rotation of the eccentric cam 316. The elevator mechanism 314 is impelled in the upward direction in FIG. 13 (the direction receding from the recording medium 16) by means of an impelling member 324. According to the composition shown in FIG. 13, by causing the eccentric cam 316 to rotate by driving the motor 318, and thus pushing the guide member 322 downward, one of the absorbing rollers 300, 302 and 304 is set to the on state.

The system controller 72 shown in FIG. 14 sends a signal for selecting one of the absorbing rollers 300, 302 and 304 to an absorbing roller selection control unit 400 in accordance with the type of recording medium 16 used, and the absorbing roller selection control unit 400 controls a drive source 310 in such a manner that the one of the absorbing rollers 300, 302 and 304 is to be used.

When the one of the absorbing rollers 300, 302 and 304 has been selected in accordance with the type of recording medium 16 in this way, then the system controller 72 controls the motor 318 through the pressing control unit 85, thereby controlling the on and off state of the absorbing roller. The type of recording medium 16 may be determined by using the medium information which has been preset by means of the medium determination unit 96, or the type of recording medium 16 may be determined in accordance with the determination result of the surface characteristics sensor 122.

The description of the present embodiments relates to the surface properties of the recording medium 16 and the absorbing roller 100, which makes contact with the ink on the recording medium 16, but the present invention may also be applied to members other than the absorbing roller 100. For example, in the belt cleaning unit 36 shown in FIG. 1, the relationship between the surface properties of the cleaning unit which makes contact with, and removes, the ink adhering to the belt 33, and the surface properties of the belt 33, can be set according to the present invention, in such a manner that the ink adheres readily to the cleaning member.

Moreover, the relationship between the surface properties of the cleaning roller 112 shown in FIG. 3 and the surface properties of the absorbing roller 100 can be set according to the present invention, in such a manner that ink (soiling) adheres readily to the cleaning roller 112.

Further Embodiments

The one treatment liquid ejection head 12S is disposed at the furthest upstream position of the print unit 12 (see FIG. 1) in the above-described embodiments; however, in implementing the present invention, the arrangement of the treatment liquid ejection head is not limited to this, and it is also possible to adopt a composition in which a treatment liquid ejection head is appended at least one position between the color ink ejection heads in the print unit 12.

Furthermore, an ejection head based on an inkjet method is used as the device for applying treatment liquid in the embodiments described above, but instead of or in combination with this, it is also possible to use a device which applies treatment liquid to the recording medium 16 by using a contacting member, such as a roller, brush, blade, or the like.

In the above-described embodiments, the treatment liquid ejection head 12S which ejects one type of treatment liquid is shown, but it is also possible to compose the treatment liquid ejection head 12S from a plurality of heads, or to use a composition in which treatment liquid of two or more types can be ejected selectively.

In the above-described embodiments, the inkjet recording apparatus using the page-wide full line type heads having the nozzle rows of the length corresponding to the entire width of the recording medium 16 is described, but the scope of application of the present invention is not limited to this, and the present invention may also be applied to an inkjet recording apparatus using a shuttle head which performs image recording while moving a recording head of short dimensions, in a reciprocal fashion.

In the above-described embodiments, the absorbing roller 100 (300, 302, 304) has a length corresponding to the width of the recording medium 16 in the lengthwise direction, but it is also possible to adopt a composition where the absorbing roller 100 (300, 302, 304) has a structure which is divided in the lengthwise direction thereof, in such a manner that liquid removal can be performed independently by means of each divided portion of the absorbing roller 100 (300, 302, 304). In this case, the absorbing roller 100 (300, 302, 304) can be controlled finely in accordance with the distribution of solvent on the recording medium 16, and moreover, improved maintenance characteristics can be expected in the absorbing roller 100 (300, 302, 304).

In the above-described embodiments, the inkjet recording apparatus for forming images on the recording medium 16 by ejecting ink from nozzles provided in print heads is described, but the scope of application of the present invention is not limited to this, and it may also be applied broadly to image forming apparatuses which form images (three-dimensional shapes) by means of liquids other than ink, such as resist, or to liquid ejection apparatuses, such as dispensers, which eject liquid chemicals, water, or the like, from nozzles (ejection holes).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

at least one ejection head which forcefully ejects liquid containing image forming material through holes provided in the at least one ejection head onto a recording medium to form a desired image on the recording medium;

a conveyance device which moves at least one of the recording medium and the ejection head so as to move the recording medium in a conveyance direction relatively to the ejection head; and a contact device which makes contact with the liquid to remove the liquid on the recording medium without removing more than a tolerable amount of the image forming material and is arranged on a downstream side of the ejection head in the conveyance direction, the contact device having a contact surface that contacts with the liquid and satisfies at least one of the following conditions: that a surface roughness of the contact surface is greater than a surface roughness of the recording medium; that a surface free energy of the contact surface is smaller than a surface free energy of the recording medium; and that a contact angle of the liquid on the contact surface is smaller than a contact angle of the liquid on the recording medium.

2. The image forming apparatus as defined in claim 1, wherein the contact device includes:

a pipe on which suction holes are arranged; and a suction unit which suctions the liquid through the suction holes to remove the liquid from the recording medium.

3. An image forming apparatus, comprising:

at least one ejection head which forcefully ejects liquid containing image forming material through holes provided in the at least one ejection head onto a recording medium to form a desired image on the recording medium;

a conveyance device which moves at least one of the recording medium and the ejection head so as to move the recording medium in a conveyance direction relatively to the ejection head;

a contact device which makes contact with the liquid to remove the liquid on the recording medium without removing more than a tolerable amount of the image forming material and is arranged on a downstream side of the ejection head in the conveyance direction, the contact device having a contact surface that contacts with the liquid and satisfies at least one of the following conditions: That the surface roughness of the contact surface is not less than twice the surface roughness of the recording medium; that the surface free energy of the contact surface is not more than a half the surface free energy of the recording medium; and that the contact angle of the liquid on the contact surface is not more than a half the contact angle of the liquid on the recording medium.

4. The image forming apparatus as defined in claim 3, wherein the contact device includes:

a pipe on which suction holes are arranged; and a suction unit which suctions the liquid through the suction holes to remove the liquid from the recording medium.

5. An image forming apparatus comprising:

an ejection head which ejects liquid onto a recording medium to form a desired image on the recording medium;

a conveyance device which moves at least one of the recording medium and the ejection head so as to move the recording medium in a conveyance direction relatively to the ejection head;

a contact device which makes contact with the liquid on the recording medium and is arranged on a downstream side of the ejection head in the conveyance direction, the contact device having surface properties satisfying at least one of the following conditions: that a surface roughness of the contact device is greater than a surface roughness of the recording medium; that a surface free energy of the contact device is smaller than a surface free energy of the recording medium; and that a contact angle of the liquid on the contact device is smaller than a contact angle of the liquid on the recording medium;

another contact device having surface properties different from the former contact device, in respect of at least one of the surface roughness, the surface free energy and the contact angle of the liquid; and a switching device which select one of the contact devices to make contact with the liquid on the recording medium.

6. The image forming apparatus as defined in claim 5, further comprising:

a recording medium determination device which determines a type of the recording medium; and a switching control device which controls the switching device according to the type of the recording medium determined by the recording medium determination device.

7. An inkjet recording apparatus, comprising:

an ejection head which ejects ink onto a recording medium to form a desired image on the recording medium;

a conveyance device which moves at least one of the recording medium and the ejection head so as to move the recording medium in a conveyance direction relatively to the ejection head; and a contact device which makes contact with the ink on the recording medium to remove a liquid portion of the ink while leaving substantially all of the image forming material of the ink behind, The contact device being arranged on a downstream side of the ejection head in the conveyance direction, the contact device having a contact surface that contacts with the ink and satisfies at least one of the following conditions: that a surface roughness of the contact surface is greater than a surface roughness of the recording medium; that a surface free energy of the contact surface is smaller than a surface free energy of the recording medium; and that a contact angle of the ink on the contact surface is smaller than a contact angle of the ink on the recording medium.

8. The inkjet recording apparatus as defined in claim 7, further comprising a treatment liquid ejection head which ejects treatment liquid which fixes the ink on the recording medium by reacting with the ink.

9. The image forming apparatus as defined in claim 7, wherein the contact device includes:

a pipe on which suction holes are arranged; and a suction unit which suctions the liquid portion through the suction holes to remove the liquid portion from the recording medium.

* * * * *